US007674097B2

(12) United States Patent
Okamoto et al.

(10) Patent No.: US 7,674,097 B2
(45) Date of Patent: Mar. 9, 2010

(54) ROTARY EXPANDER

(75) Inventors: Masakazu Okamoto, Osaka (JP); Michio Moriwaki, Osaka (JP); Eiji Kumakura, Osaka (JP); Tetsuya Okamoto, Osaka (JP); Katsumi Sakitani, Osaka (JP)

(73) Assignee: Daikin Industries, Ltd., Osaka-shi, Osaka (JP)

( * ) Notice: Subject to any disclaimer, the term of this patent is extended or adjusted under 35 U.S.C. 154(b) by 651 days.

(21) Appl. No.: 10/591,918

(22) PCT Filed: Mar. 4, 2005

(86) PCT No.: PCT/JP2005/003792

§ 371 (c)(1),
(2), (4) Date: Sep. 7, 2006

(87) PCT Pub. No.: WO2005/088077

PCT Pub. Date: Sep. 22, 2005

(65) Prior Publication Data

US 2007/0196227 A1 Aug. 23, 2007

(30) Foreign Application Priority Data

Mar. 10, 2004 (JP) ..... 2004-067315

(51) Int. Cl.
*F01C 1/30* (2006.01)
*F03C 2/00* (2006.01)

(52) U.S. Cl. ..... 418/3; 418/11; 418/15; 418/58; 418/60; 418/65

(58) Field of Classification Search ..... 418/3, 418/11, 15, 58, 60, 65, 270; 417/213, 283, 417/310, 440

See application file for complete search history.

(56) References Cited

FOREIGN PATENT DOCUMENTS

| | | | |
|---|---|---|---|
| JP | 59-52343 | | 4/1984 |
| JP | 61-122301 | U | 8/1986 |
| JP | 63-42802 | U | 3/1988 |
| JP | 63-201303 | A | 8/1988 |
| JP | 7-217406 | A | 8/1995 |
| JP | 8-338356 | A | 12/1996 |
| JP | 2001-116371 | A | 4/2001 |
| JP | 2003-269103 | A | 9/2003 |
| JP | 2004-44569 | A | 2/2004 |

*Primary Examiner*—Theresa Trieu
(74) *Attorney, Agent, or Firm*—Birch, Stewart, Kolasch & Birch, LLP

(57) ABSTRACT

Two rotary mechanism parts (70, 80) are provided in a rotary expander (60). The first rotary mechanism part (70) is smaller in displacement volume than the second rotary mechanism part (80). A first low-pressure chamber (74) of the first rotary mechanism part (70) and a second high-pressure chamber (83) of the second rotary mechanism part (80) are fluidly connected together by a communicating passageway (64), thereby forming a single expansion chamber (66). High-pressure refrigerant introduced into the first rotary mechanism part (70) expands in the expansion chamber (66). An injection passageway (37) is fluidly connected to the communicating passageway (64). When an motor-operated valve (90) is placed in the open state, high-pressure refrigerant is introduced into the expansion chamber (66) also from the injection passageway (37). This makes it possible to inhibit the drop in power recovery efficiency, even in the condition that causes the actual expansion ratio to fall below the design expansion ratio.

7 Claims, 15 Drawing Sheets

(A)

(B)

ROTARY EXPANDER

This application is the national phase application under 35 U.S.C. § 371 of PCT International Application No. PCT/JP2005/003792, which has an International filing date of Mar. 4, 2005, designating the United States of America, and claims priority of Japanese Application No. 2004-067315, filed Mar. 10, 2004.

TECHNICAL FIELD

The present invention relates to an expander for producing power by the expansion of high-pressure fluid.

BACKGROUND ART

Expanders adapted to produce power by high-pressure fluid expansion, such as positive displacement expanders including rotary expanders, have been known in the conventional technology (see, for example, Patent Document I). This type of expander can be used for the execution of an expansion process in a vapor compression refrigeration cycle (see, for example, Patent Document II).

Such an expander has a cylinder and a piston which orbits around and along the inner peripheral surface of the cylinder, wherein an expansion chamber, defined between the cylinder and the piston, is divided into two zones, namely a suction/expansion side and a discharge side. And, with the orbital motion of the piston, the expansion chamber undergoes sequential switching that one zone serving as the suction/expansion side is switched to serve as the discharge side while the other zone serving as the discharge side is switched to serve as the suction/expansion side, whereby the action of suction/expansion of high-pressure fluid and the action of discharge of high-pressure fluid are simultaneously concurrently achieved.

In the above-described expander, both the angular range of a suction process in which high-pressure fluid is supplied into the cylinder during a single revolution of the piston and the angular range of an expansion process in which the fluid is expanded are predetermined. In other words, for such a type of expander, the expansion ratio, i.e., the density ratio of suction refrigerant and discharge refrigerant, is generally constant. And, high-pressure fluid is introduced into the cylinder in the angular range of the suction process while on the other hand the fluid is expanded at a fixed expansion ratio in the angular range of the remaining expansion process for the recovery of rotational power.

Patent Document I: JP H8-338356A

Patent Document II: JP 2001-116371A

DISCLOSURE OF THE INVENTION

Problems that the Invention Intends to Solve

As just described above, positive displacement expanders have an inherent expansion ratio. On the other hand, in a vapor compression refrigeration cycle in which such an expander is used, the high-level pressure and the low-level pressure of the refrigeration cycle vary due to variations in the temperature of a target for cooling or due to variations in the temperature of a target for heat liberation (heating). And the ratio of the high-level pressure and the low-level pressure (i.e., the pressure ratio) varies as well. In connection with this, the sucked refrigerant and the discharged refrigerant of the expander each vary in density. Accordingly, in this case, the refrigeration cycle is operated at a different expansion ratio from the expansion ratio of the expander. This results in the drop in operation efficiency.

For example, in the condition that causes decreasing of the pressure ratio of the vapor compression refrigeration cycle, the ratio of the density of refrigerant at the inlet of a compressor and the density of refrigerant at the inlet of an expander decreases. However, when both the compressor and the expander are positive displacement fluid machines and they are brought into fluid communication with each other by a single shaft, the ratio of the volume flow rate of refrigerant passing through the compressor and the volume flow rate of refrigerant passing through the expander is always constant and remains unchanged. For this reason, when the pressure ratio of the vapor compression refrigeration cycle decreases, the mass flow rate of refrigerant passing through the expander becomes excessively small relative to the mass flow rate of refrigerant passing through the compressor, thereby making it impossible to effect a refrigeration cycle in appropriate conditions.

With a view to coping with this, in the apparatus of the Patent Document II, a bypass passageway is formed in parallel with the expander. The bypass passageway is equipped with a flow rate control valve. And in the condition causing decreasing of the pressure ratio of the vapor compression refrigeration cycle, a part of refrigerant delivered to the expander is made to flow towards the bypass passageway so that refrigerant flows through the expander as well as through the bypass passageway. In this arrangement, however, the refrigerant that flows through the bypass passageway, i.e. the refrigerant that bypasses the expander, does no expansion work, thereby decreasing the amount of power recoverable by the expander and causing the operation efficiency to fall.

In addition, in the condition in which the expansion ratio is lower than a design expansion ratio, excessive expansion occurs in the expansion chamber, thereby producing a problem, that the efficiency falls. This problem is described below.

Generally, a typical expander is configured such that its maximum power recovery efficiency is obtained when being operated at a design expansion ratio. FIG. 8 graphically represents a relationship between the variation in expansion chamber volume and the variation in expansion chamber pressure in an ideal operation condition for the case of carbon dioxide refrigerant whose supercritical pressure is a high-level pressure. As shown in FIG. 8, a high-pressure fluid similar in characteristic to the incompressible fluid is supplied into the expansion chamber (66) between from point a to point b, and starts expanding at point b. After moving past point b, the pressure abruptly drops down to point c until the state changes from supercritical state to saturated state. Thereafter, the fluid is slowly reduced in pressure down to point d while expanding. Then, after the cylinder volume of the expansion chamber is increased to a maximum at point d, it becomes a discharge side and the volume is reduced. Then, the fluid is discharged to point e. Thereafter, the pressure returns to point a and the suction stroke of the next cycle starts. In the state shown in FIG. 8, the pressure at point d agrees with the low-level pressure of the refrigeration cycle.

On the other hand, in the case where the aforesaid expander is employed in an air conditioner, the actual expansion ratio of a refrigeration cycle may deviate from the design expansion ratio of the refrigeration cycle or from the inherent expansion of the expander due to variations in the operation condition such as the switching between the cooling mode of operation and the heating mode of operation and the variation in the outside air temperature, as described above. Particularly, if the actual expansion ratio of the refrigeration cycle falls below the design expansion ratio, this causes the internal pressure of the expansion chamber to become lower than the low-level pressure of the refrigeration cycle, which is a so-called excessive expansion state.

FIG. 9 is a graph which represents a relationship between the variation in volume and the variation in pressure of the expansion chamber at this time, and shows a state that the low-level pressure of the refrigeration cycle increases above that of the example of FIG. 8. In this case, fluid is supplied into the cylinder between from point a to point b. Thereafter, the pressure drops down to point d according the inherent expansion ratio of the expander. On the other hand, the low-level pressure of the refrigeration cycle is at point d' which is higher than point d. Accordingly, after completion of the expansion process, the refrigerant is increased in pressure up to point d' from point d in the exhaust process. Then, the refrigerant is discharged to point e', and the next cycle starts its suction process.

In such a situation, power is consumed for discharging refrigerant out of the expander. More specifically, the amount of power indicated by (area Y) of FIG. 9 is consumed for the discharging of refrigerant. For this reason, when falling into the excessive expansion state, the amount of power recoverable by the expander is obtained by subtracting the amount of power indicated by (area Y) from the amount of power indicated by (area X) in FIG. 9. Accordingly, in comparison with the operation condition of FIG. 8, the amount of recovery power is reduced to a large degree.

With the above problems in mind, the present invention was made. Accordingly, an object of the present invention is to make it possible for an expander to recover power even in a condition that causes decreasing of the expansion ratio, and to eliminate excessive expansion to thereby prevent a drop in operation efficiency.

Means for Solving the Problems

A first invention is directed to a rotary expander which produces power by the expansion of supplied high-pressure fluid, the rotary expander comprising: a plurality of rotary mechanism parts (70, 80), each of which includes: a cylinder (71, 81) whose both ends are blocked; a piston (75, 85) for forming a fluid chamber (72, 82) in the cylinder (71, 81); and a blade (76, 86) for dividing the fluid chamber (72, 82) into a high-pressure chamber (73, 83) on the high-pressure side and a low-pressure chamber (74, 84) on the low-pressure side; and a rotating shaft (40) which engages with the piston (75, 85) of each of the plural rotary mechanism parts (70, 80). In rotary expander of the first invention, the plural rotary mechanism parts (70, 80) have different displacement volumes from each other, and are connected in series in ascending order of the different displacement volumes; in regard to two mutually connected rotary mechanism parts among the plural rotary mechanism parts (70, 80) one of which is a front-stage side rotary mechanism part (70) and the other of which is a rear-stage side rotary mechanism part (80), the low-pressure chamber (74) of the front-stage side rotary mechanism (70) and the high-pressure chamber (83) of the rear-stage side rotary mechanism part (80) come into fluid communication with each other, resulting in the formation of a single expansion chamber (66); and the rotary expander includes: an injection passageway (37) through which a part of the high-pressure fluid is introduced into the expansion chamber (66) in the process of expansion; and a distribution control mechanism provided in the injection passageway (37).

A second invention provides a rotary expander according to the first invention in which: the cylinders (71, 81) of the plural rotary mechanism parts (70, 80) are stacked one upon the other in a layered manner with an intermediate plate (63) interposed therebetween; each said intermediate plate (63) is provided with a communicating passageway (64) wherein, in regard to two adjacent rotary mechanism parts among the plural rotary mechanism parts (70, 80) one of which is a front-stage side rotary mechanism part (70) and the other of which is a rear-stage side rotary mechanism part (80), the low-pressure chamber (74) of the front-stage side rotary mechanism (70) and the high-pressure chamber (83) of the rear-stage side rotary mechanism part (80) are brought into fluid communication with each other by the communicating passageway (64); and the injection passageway (37) is formed in the intermediate plate (63) so as to open, at a terminal end thereof, to the communicating passageway (64).

A third invention provides a rotary expander according to the first invention in which the injection passageway (37) opens, at a terminal end thereof, to the high-pressure chamber (83) of at least one rotary mechanism part among the plural rotary mechanism parts (70, 80) that has a displacement volume greater than the smallest displacement volume.

A fourth invention provides a rotary expander according to any one of the first to third inventions in which the distribution control mechanism is formed by a regulating valve (90) the valve opening of which is regulatable.

A fifth invention provides a rotary expander according to any one of the first to third inventions in which the distribution control mechanism is formed by an openable/closable solenoid valve (91).

A sixth invention provides a rotary expander according to any one of the first to third inventions in which the distribution control mechanism is formed by a differential pressure regulating valve (92) the valve opening of which varies depending on the difference in pressure between fluid in the expansion chamber (66) and fluid which has flowed out of a rotary mechanism part (80) having the greatest displacement volume.

A seventh invention provides a rotary expander of any one of the first to sixth inventions in which fluid which is introduced into the high-pressure chamber (73) of a rotary mechanism part (70) having the smallest displacement volume is carbon dioxide above critical pressure.

Working Operation

In the first invention, the rotary expander (60) includes the plural rotary mechanism parts (70, 80) which differ from each other in displacement volume. These rotary mechanism parts (70, 80) are connected in series in ascending order of their displacement volumes. In other words, the outflow side of a front-stage side rotary mechanism part (70) of smaller displacement volume is fluidly connected to the inflow side of a rear-stage side rotary mechanism part (80) of greater displacement volume.

In the rotary expander (60) of this invention, high-pressure fluid is first introduced into the high-pressure chamber (73) of a rotary mechanism part (70) having the smallest displacement volume. High-pressure fluid continuously flows into the fluid chamber (72) until its volume increases to a maximum. Subsequently, the fluid chamber (72) filled with high-pressure fluid becomes the low-pressure chamber (74) on the low-pressure side and comes into fluid communication with the high-pressure chamber (83) of a rear-stage side rotary mechanism part (80) having a greater displacement volume. The fluid in the low-pressure chamber (74) expands while flowing into the high-pressure chamber (83) of the rear-stage side rotary mechanism part (80). The fluid sequentially undergoes such expansion and is eventually delivered out of a rotary mechanism part (80) having the greatest displacement volume. And the rotating shaft (40) of the rotary expander (60) is driven by such fluid expansion.

In the rotary expander (60) of this invention, when the required expansion ratio agrees with the inherent expansion ratio, the distribution of fluid in the injection passageway (37) is interrupted by the distribution control mechanism. At this time, the operation is carried out at the design expansion ratio, and the recovery of power in the expander is achieved efficiently.

On the other hand, if, with the change in operation condition, the actual expansion ratio falls below the design expansion ratio, the distribution of high-pressure fluid in the injection passageway (37) is permitted by the distribution control mechanism, and high-pressure fluid is supplied from the injection passageway (37) to the expansion chamber (66) in which fluid is about to expand, i.e. to the expansion chamber (66) in the process of expansion. Consequently, even when the rotating speed of the rotary expander (60) is constant, the mass flow rate of refrigerant flowing out of the rotary expander (60) can be varied by regulating the flow rate of refrigerant in the injection passageway (37). In addition, in the rotary expander (60), power is recovered from fluid introduced into the expansion chamber (66) via the injection passageway (37).

In addition, excessive expansion is circumvented by introducing fluid into the expansion chamber via the injection passageway (37). In other words, if the pressure in the expansion chamber (66) decreases below the pressure at the fluid outflow side, this causes the expansion chamber to fall into an excessive expansion state. However, if high-pressure fluid is supplementarily introduced into the expansion chamber (66) from the injection passageway (37), the pressure of the expansion chamber (66) is increased up to the pressure at the fluid outflow side. Consequently, the amount of power indicated by (area Y) of FIG. 9 is no longer consumed by excessive expansion, and the operation state becomes an operation state as shown in FIG. 10 and FIG. 14 in which the refrigerant gradually expands to point d' in the process of expansion.

In the second invention, the communicating passageway (64) is formed in the intermediate plate (63). The low-pressure chamber (74) of the front-stage side rotary mechanism part (70) and the high-pressure chamber (83) of the rear-stage side rotary mechanism part (80) together form the expansion chamber (66) and they are fluidly connected together via the communicating passageway (64). In addition, in this invention, the injection passageway (37) is formed in the intermediate plate (63). The injection passageway (37) opens, at its terminal end, to the communicating passageway (64). Fluid which is supplied by way of the injection passageway (37) first flows into the communicating passageway (64) and then into the high-pressure chamber (83) of the rear-stage side rotary mechanism part (80).

In the third invention, the terminal end of the injection passageway (37) opens to the high-pressure chamber (83) of at least one rotary mechanism part (80) having a greater displacement volume than the smallest displacement volume, i.e. the high-pressure chamber(s) (83) of one or more rotary mechanism parts (80) other than the frontmost-stage side rotary mechanism part (80). Fluid which is supplied through the injection passageway (37) is fed directly into the high-pressure chamber(s) (83).

In the fourth invention, the flow rate control mechanism is formed by the regulating valve (90). When the valve opening of the regulating valve (90) is changed, the amount of fluid supply to the expansion chamber (66) from the injection passageway (37) varies. In addition, when the regulating valve (90) is placed in the fully closed state, the distribution of fluid in the injection passageway (37) is interrupted.

In the fifth invention, the flow rate control mechanism is formed by the solenoid valve (91). When the solenoid valve (91) is placed in the open state, fluid is supplied to the expansion chamber (66) from the injection passageway (37), while on the other hand when the solenoid valve (91) is placed in the closed state, the supply of fluid to the expansion chamber (66) from the injection passageway (37) is stopped. In addition, if the time interval of opening and closing the solenoid valve (91) is controlled, this makes it possible to vary the amount of fluid supply to the expansion chamber (66) from the injection passageway (37).

In the sixth invention, the flow rate control mechanism is formed by the differential pressure regulating valve (92). The valve opening of the differential pressure regulating valve (92) varies depending on the difference in pressure between the fluid in the expansion chamber (66) and the fluid which has flowed out of the rearmost-stage side rotary mechanism part (80). And, as the valve opening of the differential pressure regulating valve (92) varies, the flow rate of fluid in the injection passageway (37) varies. In other words, the amount of fluid supply to the expansion chamber (66) from the injection passageway (37) is regulated depending on the difference in pressure between the fluid in the expansion chamber (66) and the fluid which has flowed out from the rearmost-stage side rotary mechanism part (80).

In the seventh invention, for the smallest in displacement volume among the plural rotary mechanism parts (70, 80), its high-pressure chamber (73) is fed dioxide carbon ($CO_2$). The pressure of dioxide carbon which is introduced into the high-pressure chamber (73) is equal to or greater than the dioxide carbon critical pressure. And the dioxide carbon which has flowed into the high-pressure chamber (73) expands while sequentially passing through the plural rotary mechanism parts (70, 80) which are fluidly connected in series.

EFFECTS OF THE INVENTION

In accordance with the present invention, it becomes possible to supplementarily introduce high-pressure fluid into the expansion chamber (66) in the process of expansion from the injection passageway (37). This therefore makes it possible to introduce the entire supplied high-pressure fluid to the expansion chamber (66) even in the operation condition in which a part of high-pressure fluid conventionally has to bypass the expander. As a result of this, it becomes possible to recover power from the entire high-pressure fluid supplied to the rotary expander (60), thereby making it possible to improve the power recovery efficiency of the rotary expander (60).

In addition, in accordance with the present invention, the occurrence of excessive expansion can be avoided by supplementarily introducing high-pressure fluid into the expansion chamber (66) in the process of expansion from the injection passageway (37), even in the operation condition which conventionally inevitably causes excessive expansion. Consequently, the amount of power indicated by (area Y) of FIG. 9 is no longer consumed by excessive expansion, thereby making it possible to surely recover power as shown in FIG. 10 and FIG. 14. As just described, in accordance with the present invention, it becomes possible to increase the amount of power recoverable from high-pressure fluid, even in the operation condition that conventionally causes excessive expansion.

In addition, in the rotary expander (60) of the present invention, high-pressure fluid supplied is first introduced into the high-pressure chamber (73) of the rotary mechanism part (70) having the smallest displacement volume. And, the flow velocity of fluid flowing towards the high-pressure chamber (73) gradually increases or decreases depending on the volume variation ratio of the high-pressure chamber (73). Consequently, in the rotary expander (60) of the present invention, the change in flow velocity of the fluid flowing towards the high-pressure chamber (73) becomes gradual, thereby making it possible to prevent the introduced fluid from undergoing abrupt pressure variation. Therefore, in accordance with the present invention, the pulsation of fluid which is introduced into the rotary expander (60) can be reduced. As a result, vibrations and noise associated with the pulsation of fluid are reduced to a large extent, thereby making it possible to improve the reliability of the rotary expander (60).

In the second invention, the injection passageway (37) is fluidly connected to the communicating passageway (64) of the intermediate plate (63). As a result of this arrangement, regardless of the position of the piston (75, 85) of the cylinder (71, 81), the injection passageway (37) can be constantly in fluid communication with the expansion chamber (66), and it becomes possible to feed fluid into the expansion chamber (66) from the injection passageway (37) during a period from the time when fluid starts expanding until the time when the fluid stops expanding, i.e., over the whole period of the process of expansion.

In accordance with the fourth invention, the flow rate control mechanism is formed by the regulating valve (90) the valve opening of which is regulatable. This therefore makes it possible to set, in a relatively free manner, the amount of fluid supply to the expansion chamber (66) from the injection passageway (37). It therefore becomes possible to deliver an adequate amount of fluid into the expansion chamber (66) from the injection passageway (37), thereby making it possible to surely improve the power recovery efficiency of the rotary expander (60).

In the sixth invention, the valve opening of the differential pressure regulating valve (92) which constitutes a flow rate control mechanism varies depending on the difference in pressure between the fluid in the expansion chamber (66) and the fluid which has flowed out of the rearmost-stage rotary mechanism part (80). Here, if excessive expansion occurs in the expansion chamber (66), the pressure of the fluid in the expansion chamber (66) falls below the pressure of the fluid which has flowed out of the rearmost-stage rotary mechanism part (80). For this reason, if the differential pressure regulating valve (92) is constituted such that the valve opening increases as the pressure of the fluid in the expansion chamber (66) becomes lower relative to the pressure of the fluid which has flowed out of the rearmost-stage rotary mechanism part (80), this makes it possible to automatically regulate the amount of fluid supply to the expansion chamber (66) from the injection passageway (37) by the differential pressure regulating valve (92). Therefore, in accordance with this invention, it is possible to optimize the amount of fluid supply to the expansion chamber (66) from the injection passageway (37), without the need for special control of the valve opening of the differential pressure regulating valve (92).

BRIEF DESCRIPTION OF THE DRAWINGS

FIG. 7 is comprised of FIG. 7(A) and FIG. 7(B), wherein FIG. 7(A) is a relational diagram which represents a relationship between the shaft rotation angle of the expansion mechanism part of the first embodiment and the inlet flow velocity of fluid, and FIG. 7(B) is a relational diagram which represents a relationship between the shaft rotation angel of a conventional rotary expander and the inlet flow velocity of fluid;

FIG. 13 is comprised of FIG. 13(A) and FIG. 13(B), wherein FIG. 13(A) is a schematic cross sectional diagram which illustrates a differential pressure regulating valve with its valve body in the closed position and FIG. 13(B) is a schematic cross sectional diagram which illustrates the differential pressure regulating valve with the valve body in the open position;

REFERENCE NUMERALS IN THE DRAWINGS

Figure 1:
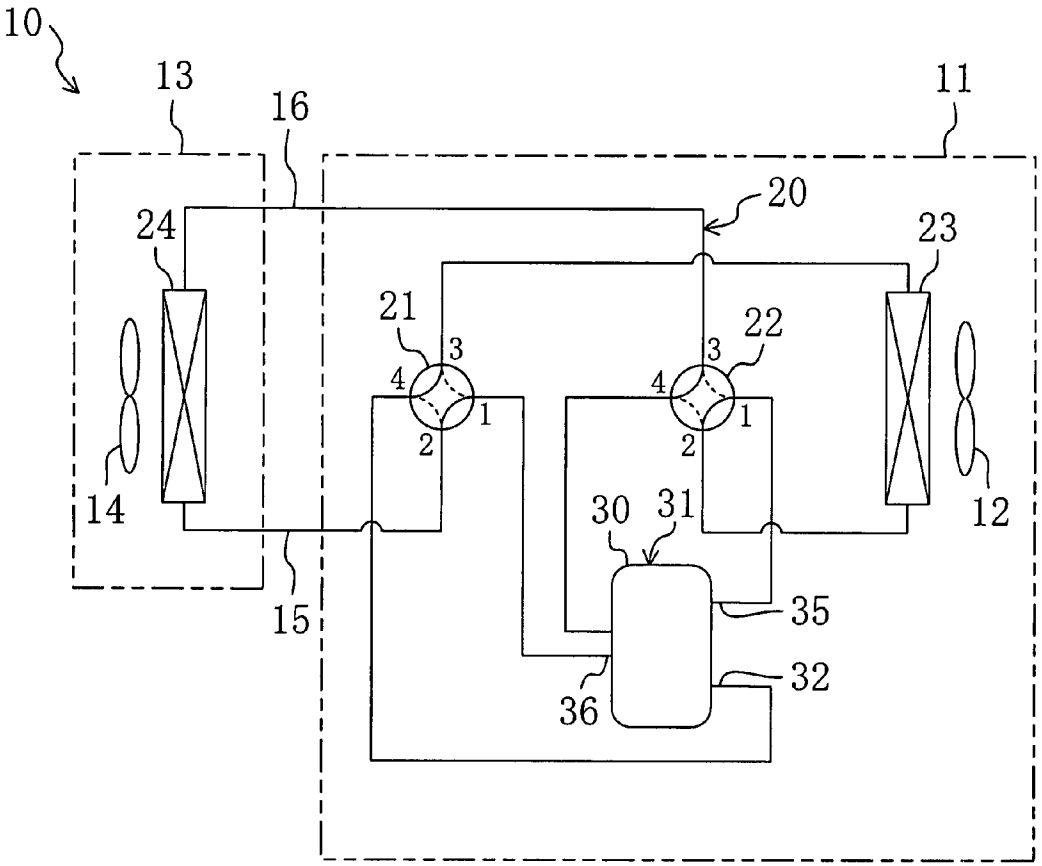
FIG. 1 is a piping system diagram of an air conditioner in a first embodiment of the present invention.

37: injection passageway
40: shaft (rotating shaft)
63: intermediate plate
64: communicating passageway
66: expansion chamber
70: first rotary mechanism part
71: first cylinder
72: first fluid chamber
73: first high-pressure chamber
74: first low-pressure chamber
75: first piston

76: first blade
80: second rotary mechanism part
81: second cylinder
82: second fluid chamber
83: second high-pressure chamber
84: second low-pressure chamber
85: second piston
86: second blade
90: motor-operated valve (distribution control mechanism, regulating valve)
91: solenoid valve (distribution control mechanism)
92: differential pressure regulating valve (distribution control mechanism)

BEST MODE FOR CARRYING OUT THE INVENTION

In the following, embodiments of the present invention will be described in detail with reference to the drawing figures.

Embodiment 1

A first embodiment of the present invention is described. An air conditioner (10) of the present embodiment is equipped with a rotary expander formed in accordance with the present invention.

Overall Structure of the Air Conditioner

With reference to FIG. 1, the air conditioner (10) is a so-called "separate type" air conditioner, and is made up of an outdoor unit (11) and an indoor unit (13). The outdoor unit (11) houses therein an outdoor fan (12), an outdoor heat exchanger (23), a first four way switching valve (21), a second four way switching valve (22), and a compression/expansion unit (30). On the other hand, the indoor unit (13) houses therein an indoor fan (14) and an indoor heat exchanger (24). The outdoor unit (11) is installed outside a building. The indoor unit (13) is installed inside the building. In addition, the outdoor unit (11) and the indoor unit (13) are connected together by a pair of interconnecting lines (15, 16). Details about the compression/expansion unit (30) will be described later.

The air conditioner (10) is equipped with a refrigerant circuit (20). The refrigerant circuit (20) is a closed circuit along which the compression/expansion unit (30), the indoor heat exchanger (24), and other components are provided. Additionally, the refrigerant circuit (20) is filled up with carbon dioxide ($CO_2$) as a refrigerant.

Both the outdoor heat exchanger (23) and the indoor heat exchanger (24) are fin and tube heat exchangers of the cross fin type. In the outdoor heat exchanger (23), refrigerant circulating in the refrigerant circuit (20) exchanges heat with a stream of outdoor air. In the indoor heat exchanger (24), refrigerant circulating in the refrigerant circuit (20) exchanges heat with a stream of indoor air.

The first four way switching valve (21) has four ports. In the first four way switching valve (21), the first port is fluidly connected to a discharge pipe (36) of the compression/expansion unit (30); the second port is fluidly connected to one end of the indoor heat exchanger (24) via the interconnecting line (15); the third port is fluidly connected to one end of the outdoor heat exchanger (23); and the fourth port is fluidly connected to a suction port (32) of the compression/expansion unit (30). And, the first four way switching valve (21) is switchable between a first state that allows fluid communication between the first port and the second port and fluid communication between the third port and the fourth port (as indicated by the solid line in FIG. 1) and a second state that allows fluid communication between the first port and the third port and fluid communication between the second port and the fourth port (as indicated by the broken line in FIG. 1).

The second four way switching valve (22) has four ports. In the second four way switching valve (22), the first port is fluidly connected to an outflow port (35) of the compression/expansion unit (30); the second port is fluidly connected to the other end of the outdoor heat exchanger (23); the third port is fluidly connected to the other end of the indoor heat exchanger (24) via the interconnecting line (16); and the fourth port is fluidly connected to an inflow port (34) of the compression/expansion unit (30) and to an injection passageway (37). And, the second four way switching valve (22) is switchable between a first state that allows fluid communication between the first port and the second port and fluid communication between the third port and the fourth port (as indicated by the solid line in FIG. 1) and a second state that allows fluid communication between the first port and the third port and fluid communication between the second port and the fourth port (as indicated by the broken line in FIG. 1).

Structure of the Compression/Expansion Unit

Figure 2:
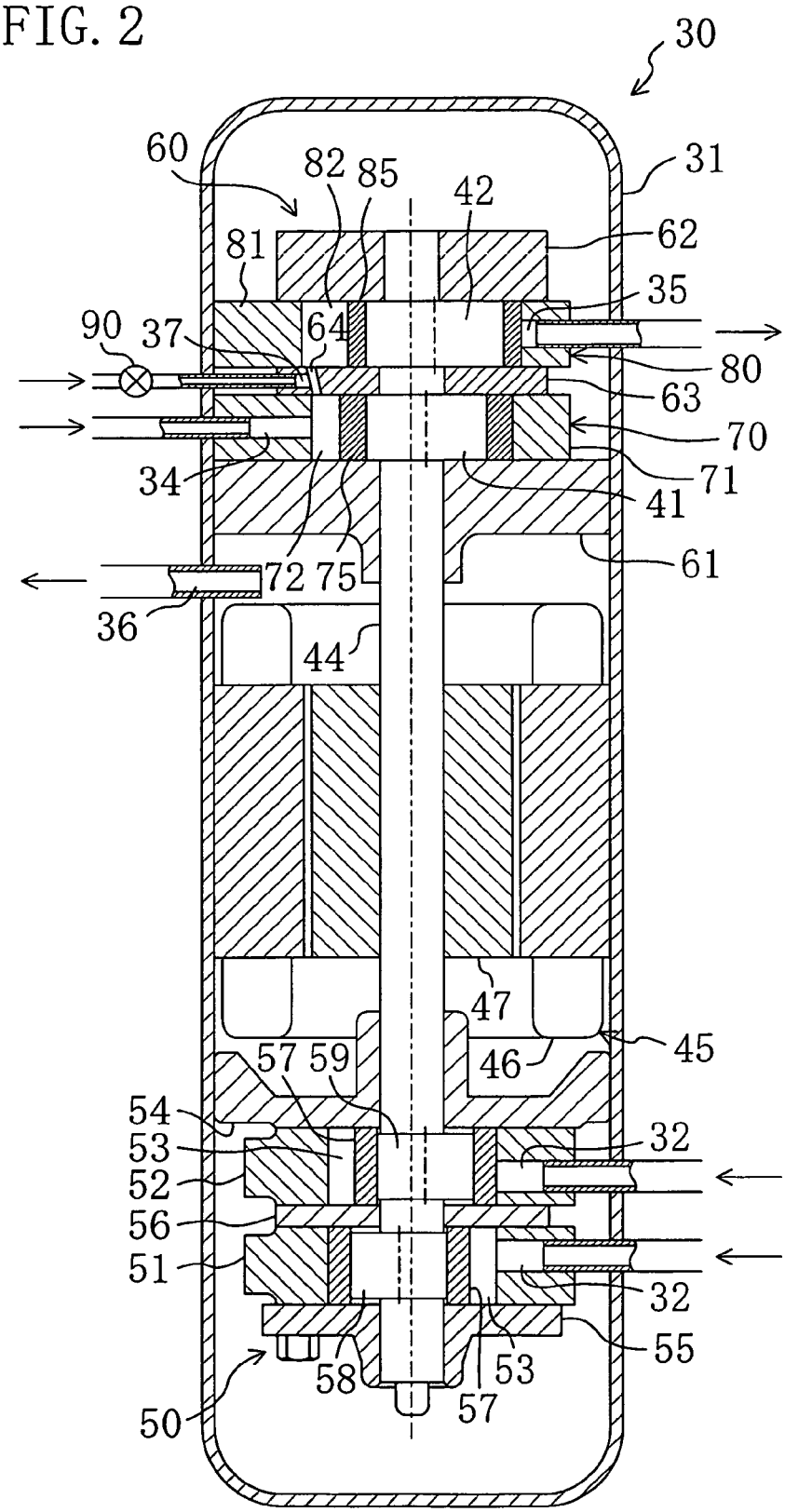
FIG. 2 is a schematic cross section view of a compression/expansion unit of the first embodiment.

As shown in FIG. 2, the compression/expansion unit (30) includes a casing (31) which is a vertically long, cylinder-shaped, hermitically-closed container. Arranged, in sequence in a bottom-to-top direction, within the casing (31) are a compression mechanism part (50), an electric motor (45), and an expansion mechanism part (60).

The discharge pipe (36) is attached to the casing (31). The discharge pipe (36) is arranged between the electric motor (45) and the expansion mechanism (60) and is brought into fluid communication with the internal space of the casing (31).

The electric motor (45) is disposed in a longitudinally central portion of the casing (31). The electric motor (45) is made up of a stator (46) and a rotor (47). The stator (46) is firmly secured to the casing (31). The rotor (47) is disposed inside the stator (46). In addition, a main shaft part (44) of a shaft (40) is passed through the rotor (47) coaxially with the rotor (47).

The shaft (40) constitutes a rotating shaft. The shaft (40) is provided, at its lower end side, with two lower side eccentric parts (58, 59). In addition, the shaft (40) has, at its upper end side, two greater diameter eccentric parts (41, 42).

The two lower side eccentric parts (58, 59) are formed so as to be greater in diameter than the main shaft part (44), wherein the lower one constitutes a first lower side eccentric part (58) and the upper one constitutes a second lower side eccentric part (59). The first lower side eccentric part (58) and the second lower side eccentric part (59) are opposite to each other in eccentric direction relative to the center of axle of the main shaft part (44).

The two greater diameter eccentric parts (41, 42) are formed so as to be greater in diameter than the main shaft part (44), wherein the lower one constitutes a first greater diameter eccentric part (41) and the upper one constitutes a second greater diameter eccentric part (42). The first and second eccentric parts (41, 42) are made eccentric in the same direction. The outer diameter of the second greater diameter eccentric part (42) is made greater than that of the first greater diameter eccentric part (41). In addition, the amount of eccentricity relative to the center of axle of the main shaft part (44) of the second greater diameter eccentric part (42) is made greater than that of the first greater diameter eccentric part (41).

The compression mechanism part (50) constitutes a swinging piston type rotary compressor. The compressor mechanism part (50) has two cylinders (51, 52) and two pistons (57). In the compression mechanism part (50), a rear head (55), a first cylinder (51), an intermediate plate (56), a second cylinder (52), and a front head (54) are arranged one upon the other in layered manner in a bottom-to-top direction.

The first and second cylinders (51, 52) each contain therein a respective cylindrical piston, i.e. the piston (57). Although not shown diagrammatically, a flat plate-like blade is projectingly provided on the side surface of the piston (57). The blade is supported, through a swinging bush, on the cylinder (51, 52). The piston (57) within the first cylinder (51) engages with the first lower side eccentric part (58) of the shaft (40). On the other hand, the piston (57) within the second cylinder (52) engages with the second lower side eccentric part (59) of the shaft (40). The piston (57, 57) is, at its inner peripheral surface, in sliding contact with the outer peripheral surface of the lower side eccentric part (58, 59). In addition, the piston (57, 57) is, at its outer peripheral surface, in sliding contact with the inner peripheral surface of the cylinder (51, 52). And a compression chamber (53) is formed between the outer peripheral surface of the piston (57, 57) and the inner peripheral surface of the cylinder (51, 52).

The first and second cylinders (51, 52) each have a respective suction port (33). The suction port (33) radially passes through the cylinder (51, 52) and its terminal end opens at the inner peripheral surface of the cylinder (51, 52). In addition, each suction port (33) is extended to outside the casing (31) by piping.

A discharge port is formed in each of the front head (54) and the rear head (55). The discharge port of the front head (54) allows the compression chamber (53) within the second cylinder (52) to fluidly communicate with the internal space of the casing (31). The discharge port of the rear head (55) allows the compression chamber (53) within the first cylinder (51) to fluidly communicate with the internal space of the casing (31). In addition, each discharge port is provided, at its terminal end, with a respective discharge valve formed by a reed valve and is placed in the open or closed state by the discharge valve. Note that neither the discharge ports nor the discharge valves are diagrammatically shown in FIG. 2. And gas refrigerant discharged into the internal space of the casing (31) from the compression mechanism part (50) is fed out of the compression/expansion unit (30) by way of the discharge pipe (36).

The expansion mechanism part (60) is a so-called swinging piston type fluid machine, and constitutes a rotary expander of the present invention. The expansion mechanism part (60) is provided with two pair combinations of cylinders (71, 81) and pistons (75, 85). In addition, the expansion mechanism part (60) further includes a front head (61), an intermediate plate (63), and a rear head (62).

In the expansion mechanism part (60), the front head (61), the first cylinder (71), the intermediate plate (63), the second cylinder (81), and the rear head (62) are arranged one upon the other sequentially in layered manner in a bottom-to-top direction. In this state, the lower end surface of the first cylinder (71) is blocked by the front head (61) and the upper end surface of the first cylinder (71) is blocked by the intermediate plate (63). On the other hand, the lower end surface of the second cylinder (81) is blocked by the intermediate plate (63) and the upper end surface of the second cylinder (81) is blocked by the rear head (62). In addition, the inside diameter of the second cylinder (81) is greater than the inside diameter of the first cylinder (71).

The shaft (40) is passed through the front head (61), the first cylinder (71), the intermediate plate (63), the second cylinder (81), and the rear head (62) which are arranged one upon the other in layered manner. Additionally, the first greater diameter eccentric part (41) of the shaft (40) lies within the first cylinder (71) while on the other hand the second greater diameter eccentric part (42) of the shaft (40) lies within the second cylinder (81).

Figure 3:
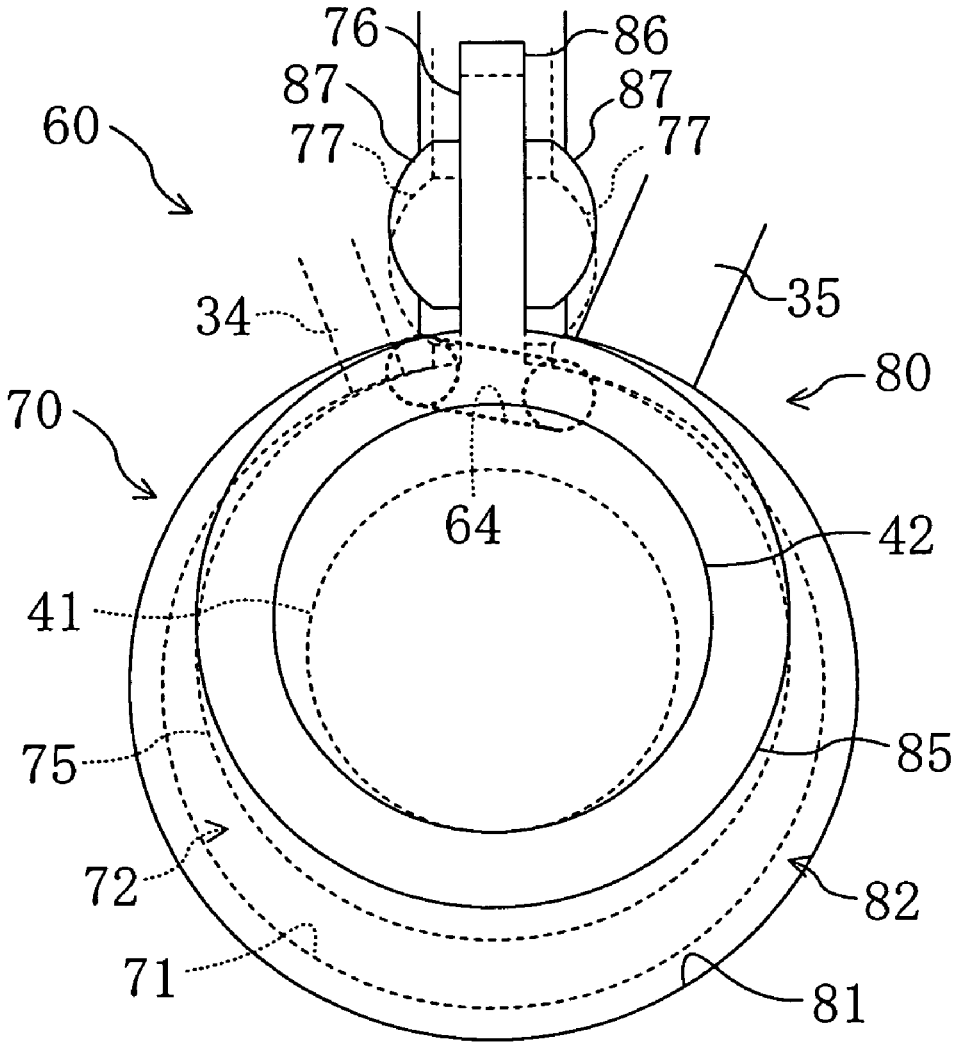
FIG. 3 is a diagram which illustrates in enlarged manner a main section of an expansion mechanism part of the first embodiment.
Figure 4:
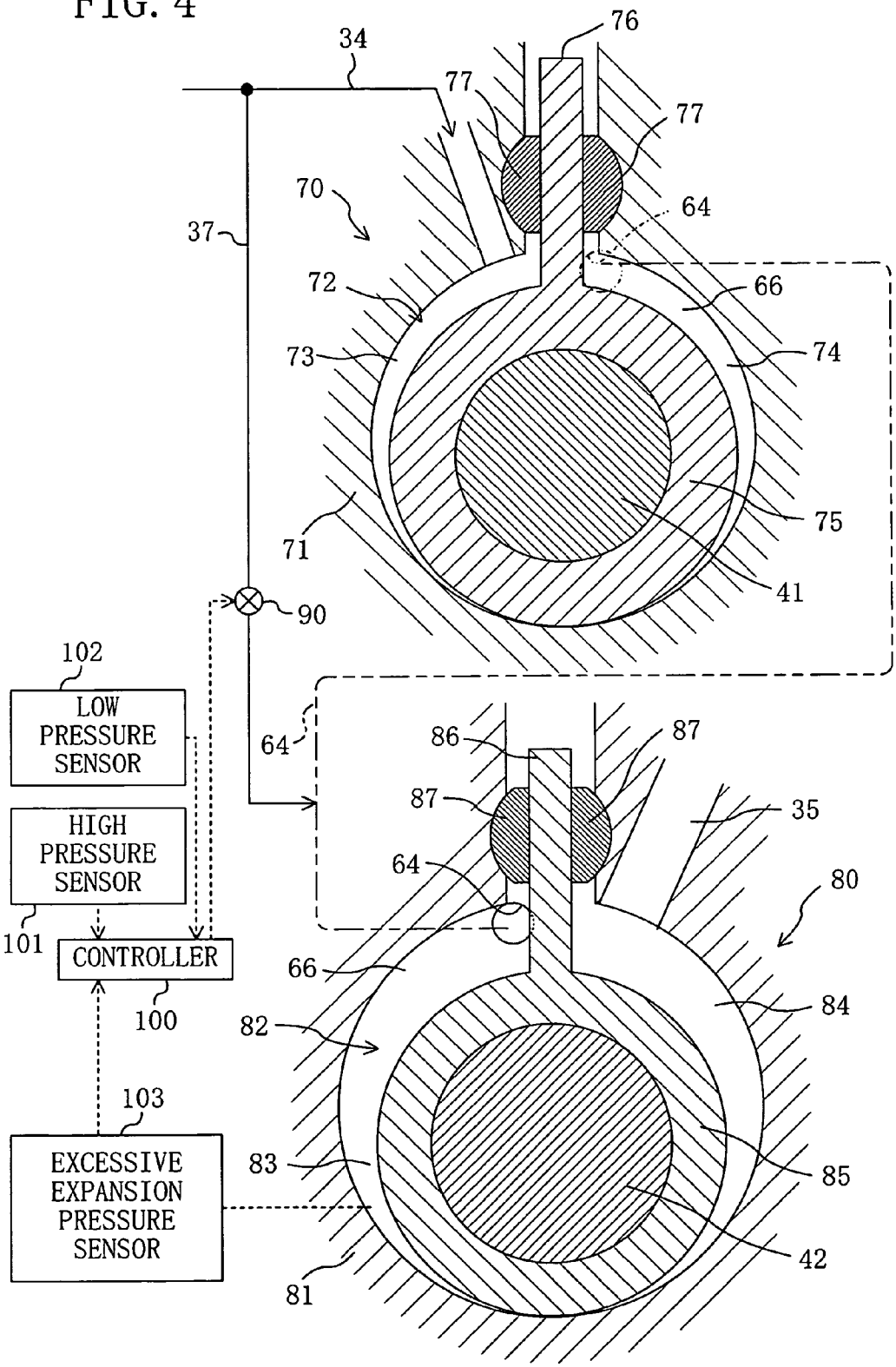
FIG. 4 is a diagram which individually illustrates in cross section rotary mechanism parts of the expansion mechanism part of the first embodiment.
Figure 5:
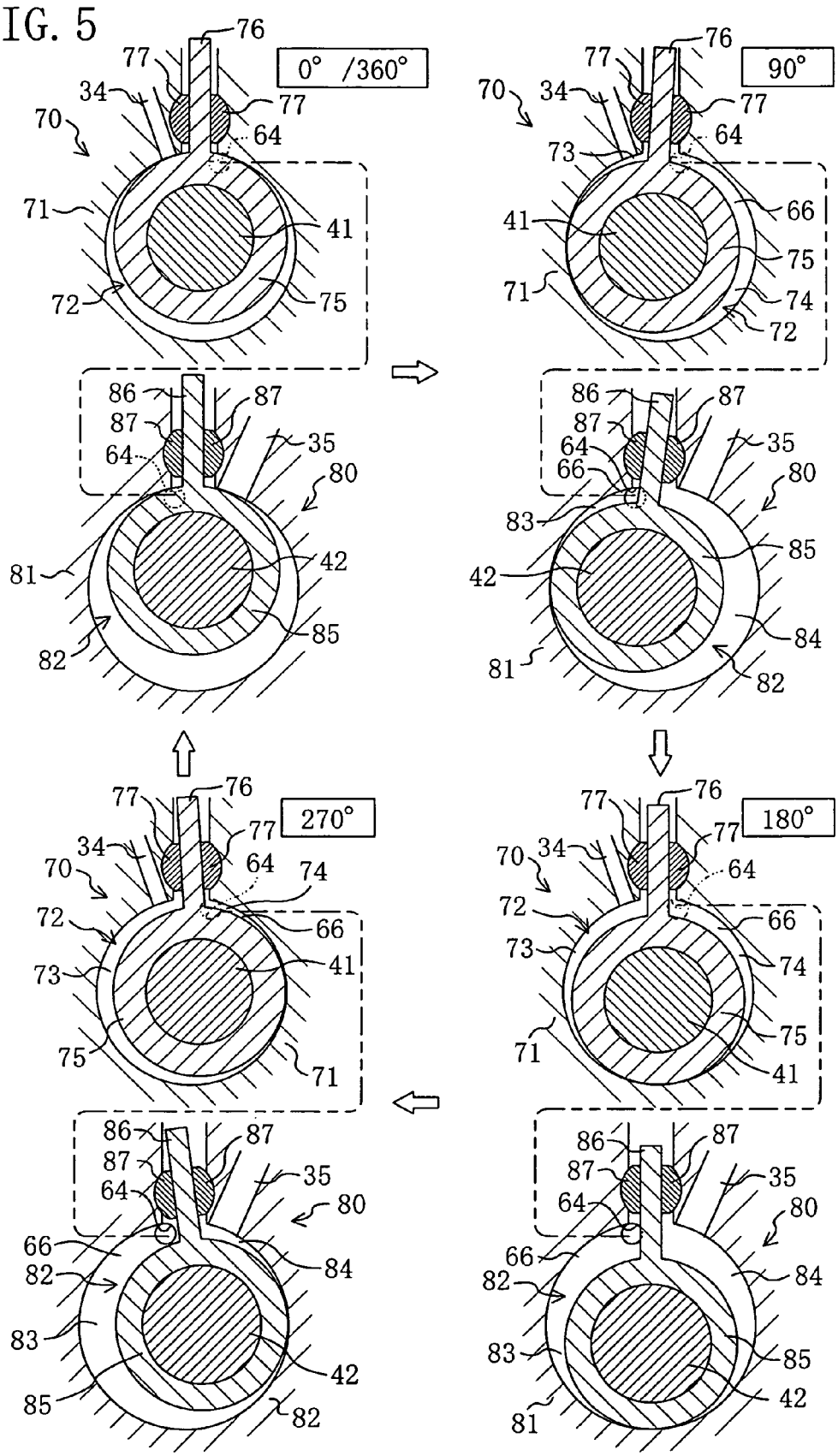
FIG. 5 is a diagram which illustrates in cross section the states of each rotary mechanism part for each 90° rotation angle of the shaft of the expansion mechanism part of the first embodiment.

As shown in FIG. 3, FIG. 4, and FIG. 5, the first piston (75) is mounted within the first cylinder (71) and the second piston (85) is mounted within the second cylinder (81). The first and second pistons (75, 85) are each shaped like a circular ring or like a cylinder. The first piston (75) and the second piston (85) are the same in outside diameter. The inside diameter of the first piston (75) approximately equals the outside diameter of the first greater diameter eccentric part (41). The inside diameter of the second piston (85) approximately equals the outside diameter of the second greater diameter eccentric part (42). And, the first greater diameter eccentric part (41) is passed through the first piston (75) and the second greater diameter eccentric part (42) is passed through the second piston (85).

The first piston (75) is, at its outer peripheral surface, in sliding contact with the inner peripheral surface of the first cylinder (71). One end surface of the first piston (75) is in sliding contact with the front head (61). The other end surface of the first piston (75) is in sliding contact with the intermediate plate (63). Within the first cylinder (71), a first fluid chamber (72) is formed between the inner peripheral surface of the first cylinder (71) and the outer peripheral surface of the first piston (75). On the other hand, the second piston (85) is, at its outer peripheral surface, in sliding contact with the inner peripheral surface of the second cylinder (81). One end surface of the second piston (85) is in sliding contact with the rear head (62). The other end surface of the second piston (85) is in sliding contact with the intermediate plate (63). Within the second cylinder (81), a second fluid chamber (82) is formed between the inner peripheral surface of the second cylinder (81) and the outer peripheral surface of the second piston (85).

The first piston (75) is provided with an integrally formed blade (76). The second piston (85) is provided with an integrally formed blade (86). The blade (76, 86) is shaped like a plate extending in the radial direction of the piston (75, 85), and projects outwardly from the outer peripheral surface of the piston (75, 85).

Each cylinder (71, 81) is provided with a respective pair of bushes (77, 87). Each bush (77, 87) is a small piece which is formed such that it has an inside surface which is a flat surface and an outside surface which is a circular arc surface. One pair of bushes (77, 87) are disposed with the blade (76, 86) sandwiched therebetween. The inside surface of each bush (77, 87) slides against the blade (76, 86) while on the other hand the outside surface thereof slides against the cylinder (71, 81). And, the blade (76, 86) integral with the piston (75, 85) is supported on the cylinder (71, 81) through the bushes (77, 87). The blade (76, 86) is allowed to freely rotate and to go up and down relative to the cylinder (71, 81).

The first fluid chamber (72) within the first cylinder (71) is divided by the first blade (76) integral with the first piston (75), wherein one space defined on the left-hand side of the first blade (76) in FIG. 4 becomes a first high-pressure chamber (73) on the high-pressure side and the other space defined on the right-hand side of the first blade (76) in FIG. 4 becomes a first low-pressure chamber (74) on the low-pressure side. The second fluid chamber (82) within the second cylinder (81) is divided by the second blade (86) integral with the second piston (85), wherein one space defined on the left-hand side of the second blade (86) in FIG. 4 becomes a second high-pressure chamber (83) on the high-pressure side and the other space defined on the right-hand side of the second blade (86) in FIG. 4 becomes a second low-pressure chamber (84) on the low-pressure side.

The first cylinder (71) and the second cylinder (81) are arranged in such orientation that the position of the buses (77) of the first cylinder (71) and that of the buses (87) of the second cylinder (81) agree with each other in circumferential direction. In other words, the disposition angle of the second cylinder (81) with respect to the first cylinder (71) is 0°. As described above, the first greater diameter eccentric part (41) and the second greater diameter eccentric part (42) are off-centered in the same direction relative to the center of axle of the main shaft part (44). Accordingly, at the same time that the first blade (76) reaches its most withdrawn position relative to the direction of the outer periphery of the first cylinder (71), the second blade (86) reaches its most withdrawn position relative to the direction of the outer periphery of the second cylinder (81).

The first cylinder (71) is provided with an inflow port (34). The inflow port (34) opens at a location of the inner peripheral surface of the first cylinder (71) somewhat nearer to the left side of the bush (77) in FIGS. 3 and 4. The inflow port (34) is allowed to be in fluid communication with the first high-pressure chamber (73) (i.e., the high pressure side of the first fluid chamber (72)). On the other hand, the second cylinder (81) is provided with an outflow port (35). The outflow port (35) opens at a location of the inner peripheral surface of the second cylinder (81) somewhat nearer to the right side of the bush (87) in FIGS. 3 and 4. The outflow port (35) is allowed to be in fluid communication with the second low-pressure chamber (84) (i.e., the low-pressure side of the second fluid chamber (82)).

The intermediate plate (63) is provided with a communicating passageway (64). The communicating passageway (64) is formed such that it extends through the intermediate plate (63) in the thickness direction thereof. In one surface of the intermediate plate (63) on the side of the first cylinder (71), one end of the communicating passageway (64) opens at a location on the right side of the first blade (76). In the other surface of the intermediate plate (63) on the side of the second cylinder (81), the other end of the communicating passageway (64) opens at a location on the left side of the second blade (86). And, as shown in FIG. 3, the communicating passageway (64) extends obliquely relative to the thickness direction of the intermediate plate (63), thereby allowing the first low-pressure chamber (74) (i.e., the low-pressure side of the first fluid chamber (72)) and the second high-pressure chamber (83) (i.e., the high-pressure side of the second fluid chamber (82)) to fluidly communicate with each other.

The injection passageway (37) is formed in the intermediate plate (63) (see FIG. 2). The injection passageway (37) is formed such that it extends substantially in horizontal direction and its terminal end opens to the communicating passageway (64). The start end of the injection passageway (37) extends to outside the casing (31) via a line. A part of high-pressure refrigerant flowing towards the inflow port (34) is introduced into the injection passageway (37). In addition, the injection passageway (37) is provided with an motor-operated valve (90). The motor-operated valve (90) is a regulating valve whose valve opening is variable, and constitutes a distribution control mechanism.

In the expansion mechanism part (60) of the present embodiment constructed in the way as described above, the first cylinder (71), the buses (77) mounted in the first cylinder (71), the first piston (75), and the first blade (76) together constitute a first rotary mechanism part (70). In addition, the second cylinder (81), the buses (87) mounted in the second cylinder (81), the second piston (85), and the second blade (86) together constitute a second rotary mechanism part (80).

As described above, in the expansion mechanism part (60), the timing at which the first blade (76) reaches its most withdrawn position relative to the direction of the outer periphery of the first cylinder (71), and the timing at which the second blade (86) reaches its most withdrawn position relative to the direction of the outer periphery of the second cylinder (81) are synchronized with each other. In other words, the process in which the volume of the first low-pressure chamber (74) decreases in the first rotary mechanism part (70), and the process in which the volume of the second high-pressure chamber (83) increases in the second rotary mechanism part (80) are in synchronization (see FIG. 5). In addition, as described above, the first low-pressure chamber (74) of the first rotary mechanism part (70) and the second high-pressure chamber (83) of the second rotary mechanism part (80) are in fluid communication with each other via the communicating passage (64). And, the first low-pressure chamber (74), the communicating passage (64), and the second high-pressure chamber (83) together form a single closed space. The closed space constitutes the expansion chamber (66). This is described with reference to FIG. 6.

Figure 6:
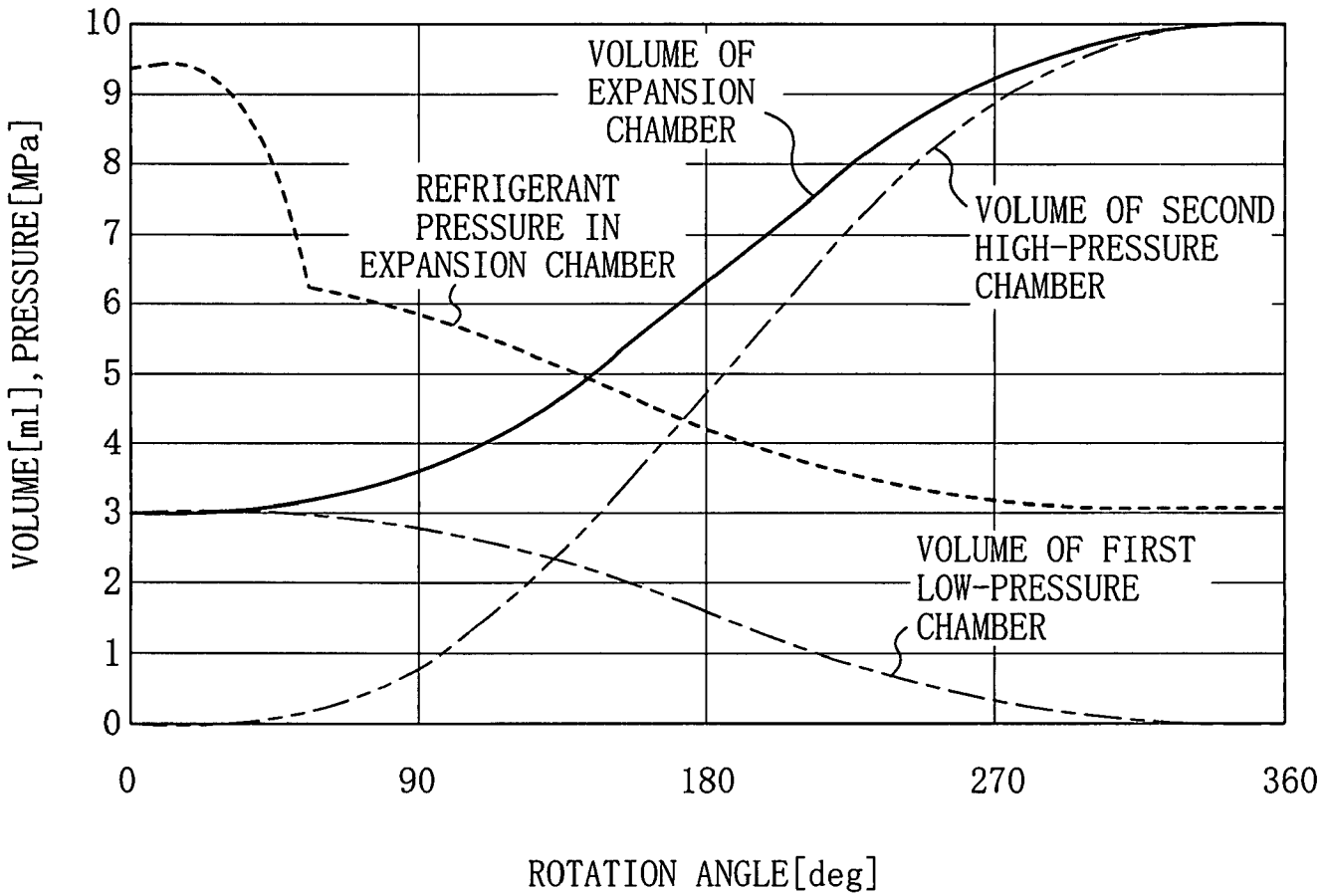
FIG. 6 is a relational diagram which represents relationships of the rotation angle of the shaft of the expansion mechanism part of the first embodiment with respect to the volume of each of chambers including an expansion chamber and with respect to the internal pressure of the expansion chamber.

In FIG. 6, the rotation angle of the shaft (40) when the first blade (76) reaches its most withdrawn position relative to the direction of the outer periphery of the first cylinder (71) is 0°. In addition, the description is made here, assuming that the maximum volume of the first fluid chamber (72) is 3 ml (milliliter) and the maximum volume of the second fluid chamber (82) is 10 ml.

With reference to FIG. 6, at the point of time when the rotation angle of the shaft (40) is 0°, the volume of the first low-pressure chamber (74) assumes its maximum value of 3 ml and the volume of the second high-pressure chamber (83) assumes its minimum value of 0 ml. The volume of the first low-pressure chamber (74), as indicated by the alternate long and short dash line in FIG. 5, gradually diminishes as the shaft (40) rotates and, at the point of time when the rotation angle of the shaft (40) reaches a point of 360°, assumes its minimum value of 0 ml. On the other hand, the volume of the second high-pressure chamber (83), as indicated by the chain double-dashed line in FIG. 5, gradually increases as the shaft (40) rotates and, at the point of time when the rotation angle of the shaft (40) reaches 360°, assumes its maximum value of 10 ml. And, the volume of the expansion chamber (66) at a certain rotation angle is the sum of the volume of the first low-pressure chamber (74) and the volume of the second high-pressure chamber (83) at that certain rotation angle, when leaving the volume of the communicating passage (64) out of count. In other words, the volume of the expansion chamber (66), as indicated by the solid line in FIG. 5, assumes a minimum value of 3 ml at the point of time when the rotation angle of the shaft (40) is 0°. As the shaft (40) rotates, the volume of the expansion chamber (66) gradually increases and assumes a maximum value of 10 ml at the point of time when the rotation angle of the shaft (40) reaches 360°.

The air conditioner (10) of the present embodiment is provided with, in addition to a high-pressure sensor (101) and a low-pressure sensor (102) which are generally provided in the refrigerant circuit (20), an excessive-expansion pressure sensor (103) for detecting the pressure of the expansion chamber (66). In addition, a controller (100), provided in the air conditioner (10), is configured so as to be able to control the valve opening of the motor-operated valve (90) based on the pressures detected by these sensors (101, 102, 103).

Running Operation

The operation of the air conditioner (10) is described. Hereinafter, the operation of the air conditioner (10) during the cooling operating mode and the operation of the air conditioner (10) during the heating operating mode are described and the operation of the expansion mechanism part (60) is described.

Cooling Operating Mode

In the cooling operating mode, the first four way switching valve (21) and the second four way switching valve (22) each change state to the state indicated by the broken line in FIG. 1. In this state, upon energization of the electric motor (45) of the compression/expansion unit (30), refrigerant circulates in the refrigerant circuit (20) whereby a vapor compression refrigeration cycle is effected.

Refrigerant compressed in the compression mechanism part (50) passes through the discharge pipe (36) and is then discharged out of the compression/expansion unit (30). In this state, the refrigerant is at a pressure above critical pressure. This discharged refrigerant is delivered by way of the first four way switching valve (21) to the outdoor heat exchanger (23). In the outdoor heat exchanger (23), the inflow refrigerant dissipates heat to outside air.

The refrigerant after heat dissipation in the outdoor heat exchanger (23) passes through the second four way switching valve (22) and then through the inflow port (34) and flows into the expansion mechanism part (60) of the compression/expansion unit (30). In the expansion mechanism part (60), the high-pressure refrigerant expands and its internal energy is converted into power which is used to rotate the shaft (40). The low-pressure refrigerant after expansion flows out of the compression/expansion unit (30) through the outflow port (35), passes through the second four way switching valve (22), and is delivered to the indoor heat exchanger (24).

In the indoor heat exchanger (24), the inflow refrigerant absorbs heat from room air and evaporates and, as a result, the room air is cooled. Low-pressure gas refrigerant exiting the indoor heat exchanger (24) passes through the first four way switching valve (21) and then through the suction port (32) and is drawn into the compression mechanism part (50) of the compression/expansion unit (30). The compression mechanism part (50) compresses the drawn refrigerant and then discharges it.

Heating Operating Mode

In the heating operating mode, the first four way switching valve (21) and the second four way switching valve (22) each change state to the state indicated by the solid line in FIG. 1. In this state, upon energization of the electric motor (45) of the compression/expansion unit (30), refrigerant circulates in the refrigerant circuit (20) whereby a vapor compression refrigeration cycle is effected.

Refrigerant compressed in the compression mechanism part (50) passes through the discharge pipe (36) and is then discharged out of the compression/expansion unit (30). In this state, the refrigerant is at a pressure above critical pressure. This discharged refrigerant passes through the first four way switching valve (21) and is then delivered to the indoor heat exchanger (24). In the indoor heat exchanger (24), the inflow refrigerant dissipates heat to room air and, as a result, the room air is heated.

The refrigerant after heat dissipation in the indoor heat exchanger (24) passes through the second four way switching valve (22) and then through the inflow port (34) and flows into the expansion mechanism part (60) of the compression/expansion unit (30). In the expansion mechanism part (60), the high-pressure refrigerant expands and its internal energy is converted into power which is used to rotate the shaft (40). The low-pressure refrigerant after expansion flows out of the compression/expansion unit (30) by way of the outflow port (35), passes through the second four way switching valve (22), and is delivered to the outdoor heat exchanger (23).

In the outdoor heat exchanger (23), the inflow refrigerant absorbs heat from outside air and evaporates. The low-pressure gas refrigerant exiting the outdoor heat exchanger (23) passes through the first four way switching valve (21) and then through the suction port (32) and is drawn into the compression mechanism part (50) of the compression/expansion unit (30). The compression mechanism part (50) compresses the drawn refrigerant and then discharges it.

Operation of the Expansion Mechanism Part

The operation of the expansion mechanism part (60) is described below.

Figure 7:
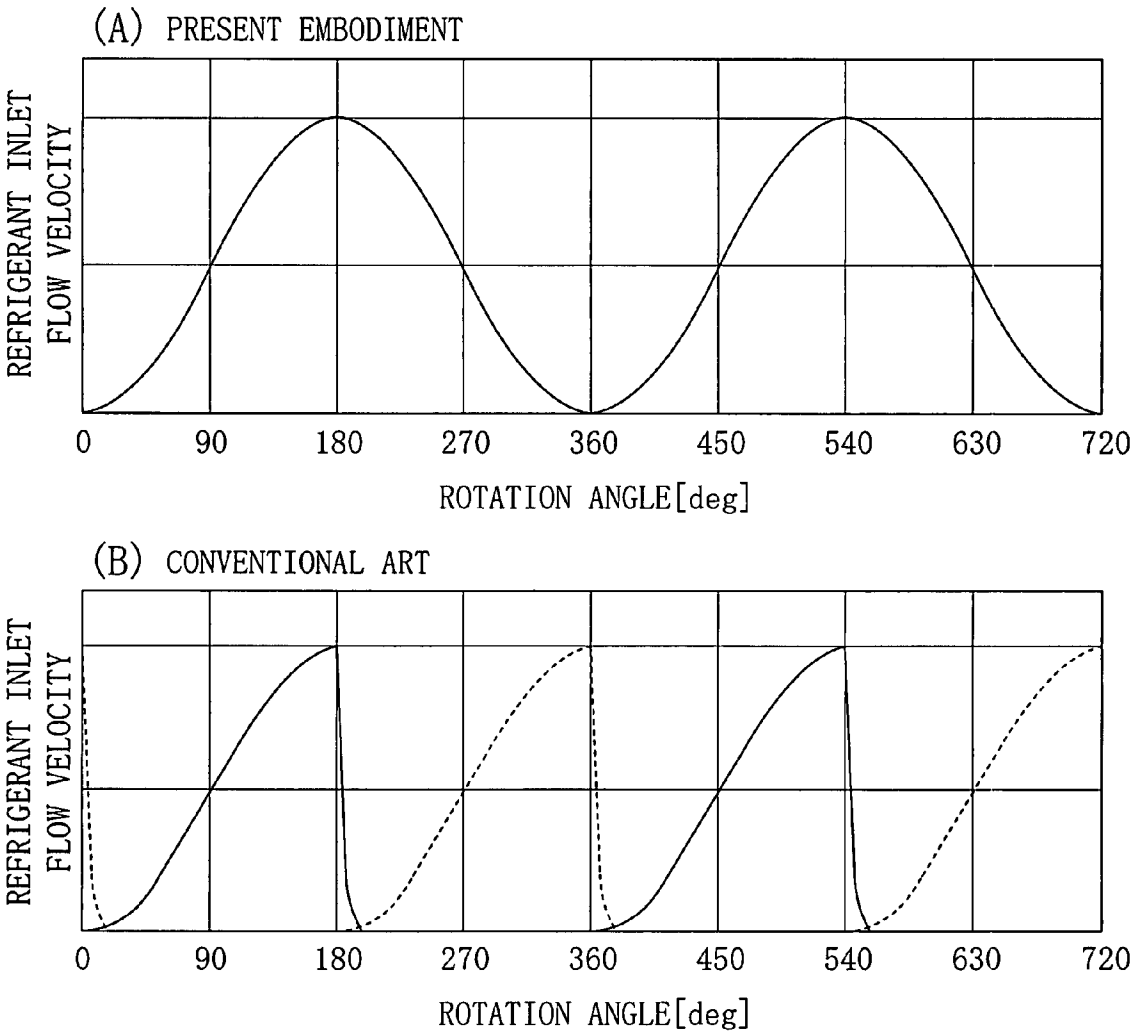

In the first place, by making reference to FIG. 5 and FIG. 7, the process in which high-pressure refrigerant in the supercritical state flows into the first high-pressure chamber (73) of the first rotary mechanism part (70) is described. When the shaft (40) makes a slight rotation from the rotation angle 0° state, the position of contact between the first piston (75) and the first cylinder (71) passes through the opening part of the inflow port (34), thereby allowing high-pressure refrigerant to start flowing into the first high-pressure chamber (73) from the inflow port (34). Thereafter, as the rotation angle of the shaft (40) gradually increases to 90°, then to 180°, and then to 270°, high-pressure refrigerant keeps flowing into the first high-pressure chamber (73). The inflowing of high-pressure refrigerant into the first high-pressure chamber (73) continues until the rotation angle of the shaft (40) reaches an angle of 360°.

At that time, the flow velocity of the high-pressure refrigerant flowing into the first high-pressure chamber (73) gradually increases until the rotation angle of the shaft (40) reaches 180° from the rotation angle of 0° while on the other hand it decreases until the rotation angle of the shaft (40) reaches 360° from the rotation angle of 180°, as shown in FIG. 7(A). And, at the point of time when the rotation angle of the shaft (40) reaches 360° and the flow velocity variation ratio of the high-pressure refrigerant becomes zero, the inflowing of the high-pressure refrigerant into the first high-pressure chamber (73) comes to an end.

Next, by making reference to FIG. 5 and FIG. 6, the process in which refrigerant expands in the expansion mechanism part (60) is described. When the shaft (40) makes a slight rotation from the rotation angle 0° state, the first low-pressure chamber (74) and the second high-pressure chamber (83) become fluidly communicative with each other via the communicating passageway (64) and, as a result, refrigerant starts flowing into the second high-pressure chamber (83) from the first low-pressure chamber (74). Thereafter, as the rotation angle of the shaft (40) gradually increases to 90°, then to 180°, and then to 270°, the volume of the first low-pressure chamber (74) gradually decreases while simultaneously the volume of the second high-pressure chamber (83) gradually increases. Consequently, the volume of the expansion chamber (66) gradually increases. The volume of the expansion chamber (66) continues to increase just before the rotation angle of the shaft (40) reaches 360°. And, in the process during which the volume of the expansion chamber (66) increases, the refrigerant in the expansion chamber (66) expands. By virtue of such refrigerant expansion, the shaft (40) is rotationally driven. In this way, the refrigerant within the first low-pressure chamber (74) flows by way of the communication passage (64) into the second high-pressure chamber (83) while expanding.

In the refrigerant expansion process, the refrigerant pressure within the expansion chamber (66) gradually falls as the rotation angle of the shaft (40) becomes increased, as indicated by the broken line in FIG. 6. More specifically, refrigerant in the supercritical state with which the first low-pressure chamber (74) is filled up undergoes an abrupt pressure drop by the time the rotation angle of the shaft (40) reaches about 55°, and enters the saturated liquid state. Thereafter, the refrigerant within the expansion chamber (66) gradually decreases in pressure while partially evaporating.

Subsequently, by making reference to FIG. 5, the process in which refrigerant flows out of the second low-pressure chamber (84) of the second rotary mechanism (80) is described. The second low-pressure chamber (84) starts fluidly communicating with the outflow port (35) from the point of time when the rotation angle of the shaft (40) is 0°. Stated another way, refrigerant starts flowing out to the outflow port (35) from the second low-pressure chamber (84). Thereafter, the rotation angle of the shaft (40) gradually increases to 90°, then to 180°, and then to 270°. Over a period of time until the rotation angle of the shaft (40) reaches 360°, low-pressure refrigerant after expansion continuously flows out of the second low-pressure chamber (84).

Control of the Motor-Operated Valve

Figure 8:
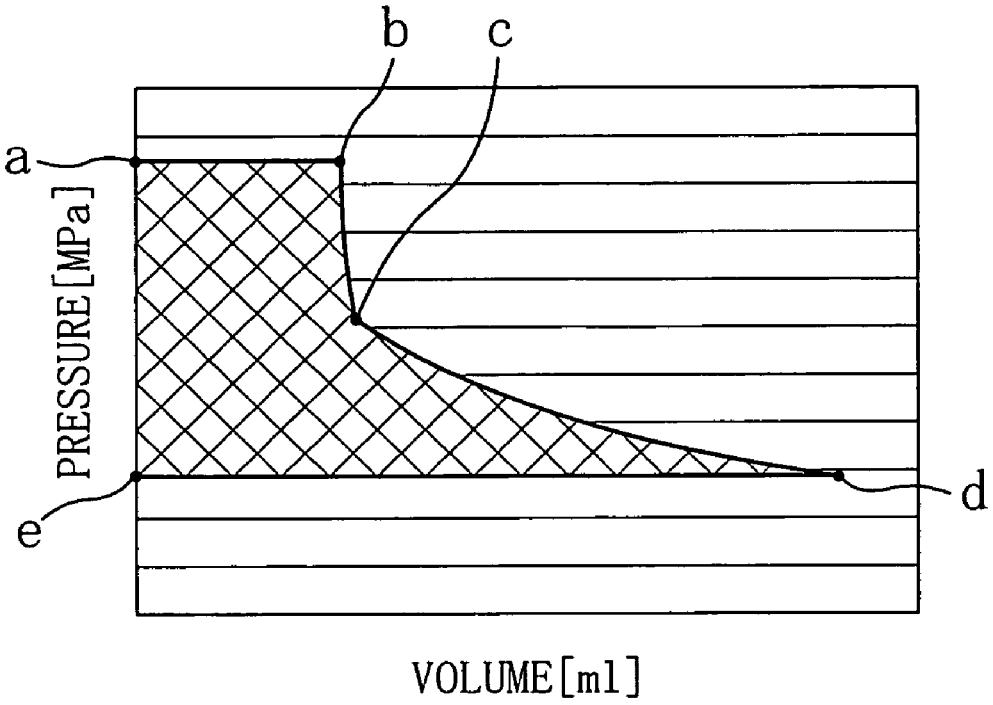
FIG. 8 is a graph which represents a relationship between the expansion chamber volume and the expansion chamber pressure in an operation condition at the design pressure.

Here, when an ideal operation for the refrigeration cycle is carried out and no excessive operation occurs in the expansion chamber (66), the motor-operated valve (90) is placed in the closed state. A volume-variation versus pressure-variation relationship in the expansion chamber (66) at this time is shown in the graph of FIG. 8. In other words, high-pressure refrigerant in the supercritical state flows into the first high-pressure chamber (73) between from point a to point b. Then, the first high-pressure chamber (73) comes into fluid communication with the communicating passageway (64) and switches to the first low-pressure chamber (74). In the expansion chamber (66) made up of the first low-pressure chamber (74) and the second high-pressure chamber (83), the inside high-pressure refrigerant abruptly drops in pressure between from point b to point c and enters the saturated state. The refrigerant in the saturated state expands while partially being evaporated, and gradually drops in pressure to point d. And the second high-pressure chamber (83) fluidly communicates with the outflow port (35) and switches to the second low-pressure chamber (84). The fluid in the second low-pressure chamber (84) is fed out to the outflow port (35) until the time to point e. At this time, the suction refrigerant/discharge refrigerant density ratio corresponds to the design expansion ratio, and operation of high power recovery efficiency is carried out.

On the other hand, in the refrigerant circuit (20), the high-level pressure and the low-level pressure may deviate from their design values due to the switching between the cooling mode of operation and the heating mode of operation or due to the variation in outside air temperature. In such a case, based on the pressures detected by the sensors (101, 102, 103), the controller (100) controls the operation in the following way.

For example, if the low-level pressure increases due to the variation in operation condition, this may causes the actual expansion ratio to fall below the design expansion ratio. With the rise in low-level pressure, the density of refrigerant drawn into the compression mechanism part (50) increases. Consequently, although the rotation speed of the shaft (40) remains constant, the mass flow rate of discharge refrigerant expelled from the compression mechanism part (50) increases. On the other hand, if the high-level pressure remains almost unchanged, the density of refrigerant flowing into the expansion mechanism (60) remains unchanged as well. Consequently, if the rotation speed of the shaft (40) is constant, the mass flow rate of refrigerant capable of flowing into the expansion mechanism part (60) remains unchanged. Accordingly, in this case, the mass flow rate of refrigerant capable of passing through the expansion mechanism part (60) becomes relatively smaller than the mass flow rate of refrigerant capable of passing through the compression mechanism part (50).

In the above operation state, the motor-operated valve (90) is placed in the open state by the controller (100), and a part of high-pressure refrigerant in the supercritical state is introduced into the expansion chamber (66) in the process of expansion from the injection passageway (37). Because of such arrangement, even in the operation condition causing the actual expansion ratio to fall below the design expansion ratio, the mass flow rate of refrigerant fed out of the expansion mechanism part (60) can be made to correspond to the mass flow rate of refrigerant discharged out of the compression mechanism part (50).

Figure 10:
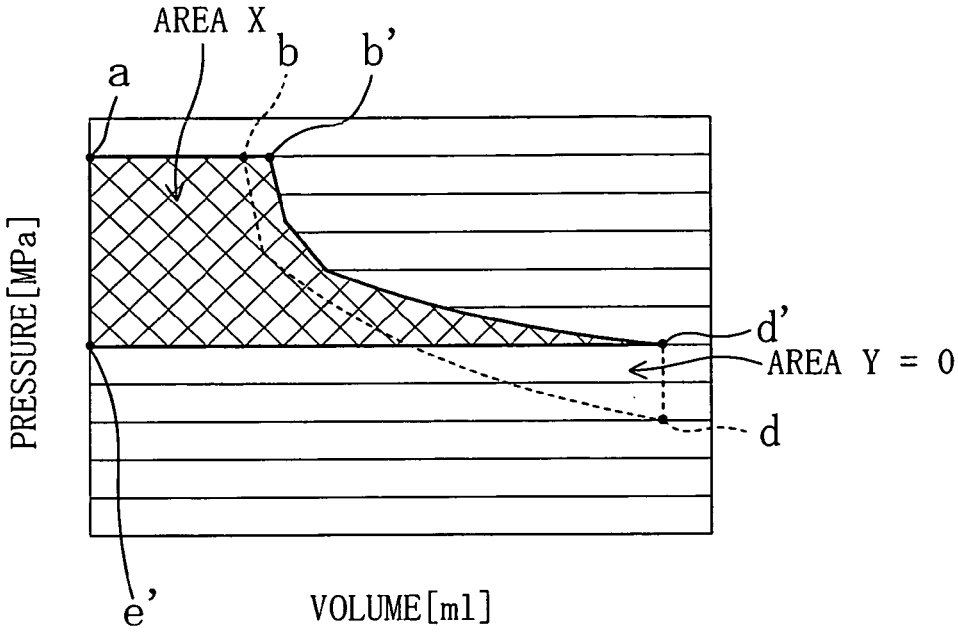
FIG. 10 is a graph which represents a relationship between the expansion chamber volume and the expansion chamber pressure in the expansion mechanism part of the first embodiment when taking a low expansion ratio measure.

Referring to FIG. 10, the state of an operation of regulating the valve opening of the motor-operated valve (90) is illustrated. In this case, after the refrigerant completes a suction process from point a to point b', it gradually expands to point d', and is discharged to point e'. In this operation state, the amount of expansion work indicated by (area X) surrounded by point a, point b', point d', and point e' is recovered as power which is used to rotate the shaft (40).

In addition, in the expansion mechanism part (60), the low-level pressure rises and the actual expansion ratio becomes smaller than the design expansion ratio, whereby it becomes possible to prevent the occurrence of excessive expansion even in the operation condition conventionally causing the expansion chamber (66) to become lower in pressure than the outflow port (35). Stated another way, when there is created a condition that causes excessive expansion in the expansion chamber (66), the motor-operated valve (90) is opened by a predetermined amount to thereby introduce a part of high-pressure refrigerant into the expansion chamber (66) in the process of expansion from the injection passageway (37). Consequently, the pressure of the expansion chamber (66) rises up to the low-level pressure of the refrigeration cycle, thereby preventing the occurrence of excessive expansion.

Figure 9:
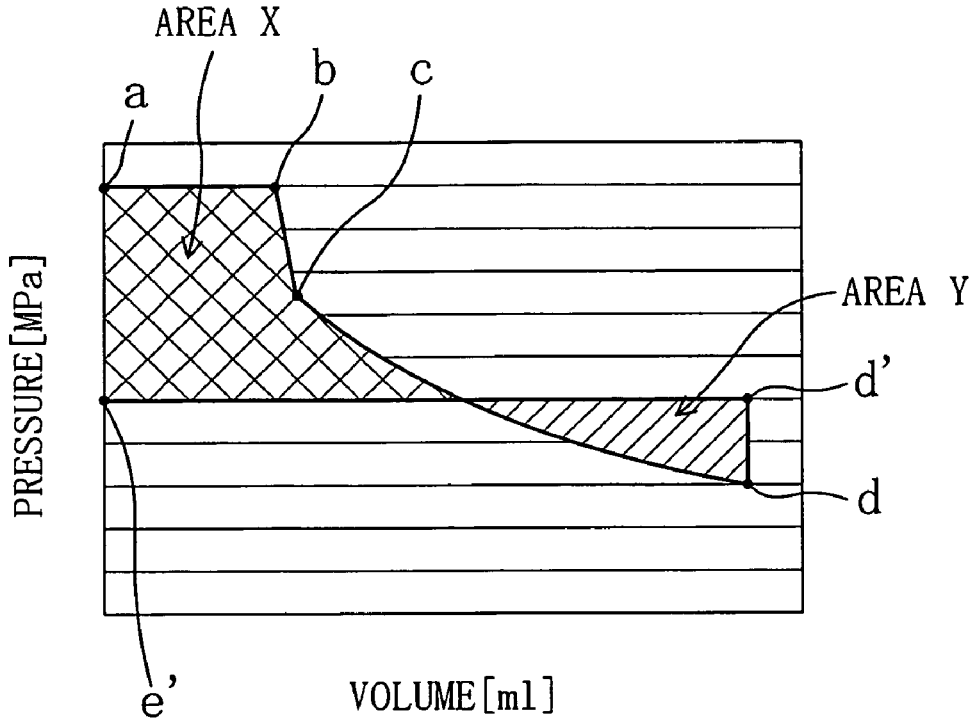
FIG. 9 is a graph which represents a relationship between the expansion chamber volume and the expansion chamber pressure in a low expansion ratio condition in a conventional expander.

Here, if the introducing of refrigerant from the injection passageway (37) is not made, this results in consumption of the power indicated by (area Y) of FIG. 9 for delivering refrigerant from the expansion mechanism part (60). On the other hand, if refrigerant is introduced from the injection passageway (37), the internal pressure of the expansion chamber (66) at the point of time when the expansion process is completed corresponds to the low-level pressure of the refrigeration cycle or becomes higher than the low-level pressure of the refrigeration cycle, and refrigerant is delivered from the expansion mechanism part (60) without power consumption.

Effects of the First Embodiment

In the present embodiment, the injection passageway (37), for introducing a part of high-pressure refrigerant in the supercritical state into the expansion chamber (66) in the process of expansion, is provided in the compression/expansion unit (30). And in the operation state that causes the expansion ratio of the refrigeration cycle to fall below the design value of the expansion mechanism part (60), the valve opening of the motor-operated valve (90) is regulated to control the flow rate of refrigerant in the injection passageway (37), thereby establishing equilibrium between the amount of discharge refrigerant from the compression mechanism part (50) and the amount of outflow refrigerant from the expansion mechanism part (60). This therefore makes it possible to introduce high-pressure refrigerant that conventionally has to bypass the expansion mechanism part (60) into the expansion chamber (66), and it becomes possible to recover power from the entire high-pressure refrigerant circulated in the refrigerant circuit (20) and then delivered to the expansion mechanism part (60).

In addition, in accordance with the present embodiment, even in the operation condition that conventionally causes excessive expansion, the motor-operated valve (90) is placed in the open state so that high-pressure refrigerant is introduced into the expansion chamber (66) from the injection passageway (37). This increases the internal pressure of the expansion chamber (66), and the occurrence of excessive expansion is avoided. Consequently, in the expansion mechanism part (60), power is no longer consumed for the discharging of refrigerant from the expansion chamber (66) due to excessive expansion. Accordingly, the loss of recovery power due to the occurrence of excessive expansion can be cut down, thereby making it possible to reduce the amount of electric power that is consumed by the electric motor (45) for driving the compression mechanism part (50).

In addition, in the expansion mechanism part (60) of the present embodiment, the injection passageway (37) is fluidly connected to the communicating passageway (64) of the intermediate plate (63). As a result of such arrangement, it becomes possible to constantly bring the injection passageway (37) into fluid communication with the expansion chamber (66), regardless of the position of the piston (75, 85) of the cylinder (71, 81), whereby high-pressure refrigerant can be delivered to the expansion chamber (66) from the injection passageway (37) from the start to the end of refrigerant expansion in the expansion chamber (66), i.e. all over the expansion process period.

In addition, in the present embodiment, the motor-operated valve (90) whose valve opening can be controlled continuously is provided in the injection passageway (37), thereby making it possible to relatively freely set the amount of high-pressure refrigerant supply to the expansion chamber (66) from the injection passageway (37). Consequently, it becomes possible to deliver an adequate amount of high-pressure refrigerant to the expansion chamber (66) from the injection passageway (37), thereby surely improving the power recovery efficiency of the expansion mechanism part (60).

In addition, in the expansion mechanism part (60) of the present embodiment, supplied high-pressure refrigerant in the supercritical state is first introduced into the first high-pressure chamber (73) of the first rotary mechanism part (70) of smaller displacement volume. And the flow velocity of fluid flowing towards the first high-pressure chamber (73) gradually increases or decreases according to the volume variation ratio of the first high-pressure chamber (73). Consequently, in the expansion mechanism part (60), the flow velocity of the high-pressure refrigerant flowing towards the first high-pressure chamber (73) varies modestly, thereby preventing the fluid which is introduced from abruptly varying in pressure. Therefore, in accordance with the present embodiment, the pulsation of high-pressure refrigerant that is introduced into the expansion mechanism part (60) is reduced and associated vibrations and noise are reduced to a large extent, and the reliability of the expansion mechanism part (60) is improved.

In addition, in the present embodiment, the expansion mechanism part (60) provided with the injection passageway (37) and the motor-operated valve (90) is applied to the air conditioner (10) which is adapted to compress carbon dioxide ($CO_2$) as a refrigerant to the supercritical state to thereby effect a vapor compression refrigeration cycle. In the air conditioner (10), excessive expansion tends to occur in the operation condition during the cooling mode of operation when the compression/expansion unit (30) is designed based on the operation condition during the heating mode of operation. Accordingly, if the air conditioner (10) of this type employs the expansion mechanism part (60), the occurrence of excessive expansion can be avoided regardless of the operation condition, thereby surely improving the operation efficiency of the air conditioner (10).

Second Embodiment of the Invention

A second embodiment of the present invention is described. In regard to the present embodiment, the difference from the first embodiment is described.

Figure 11:
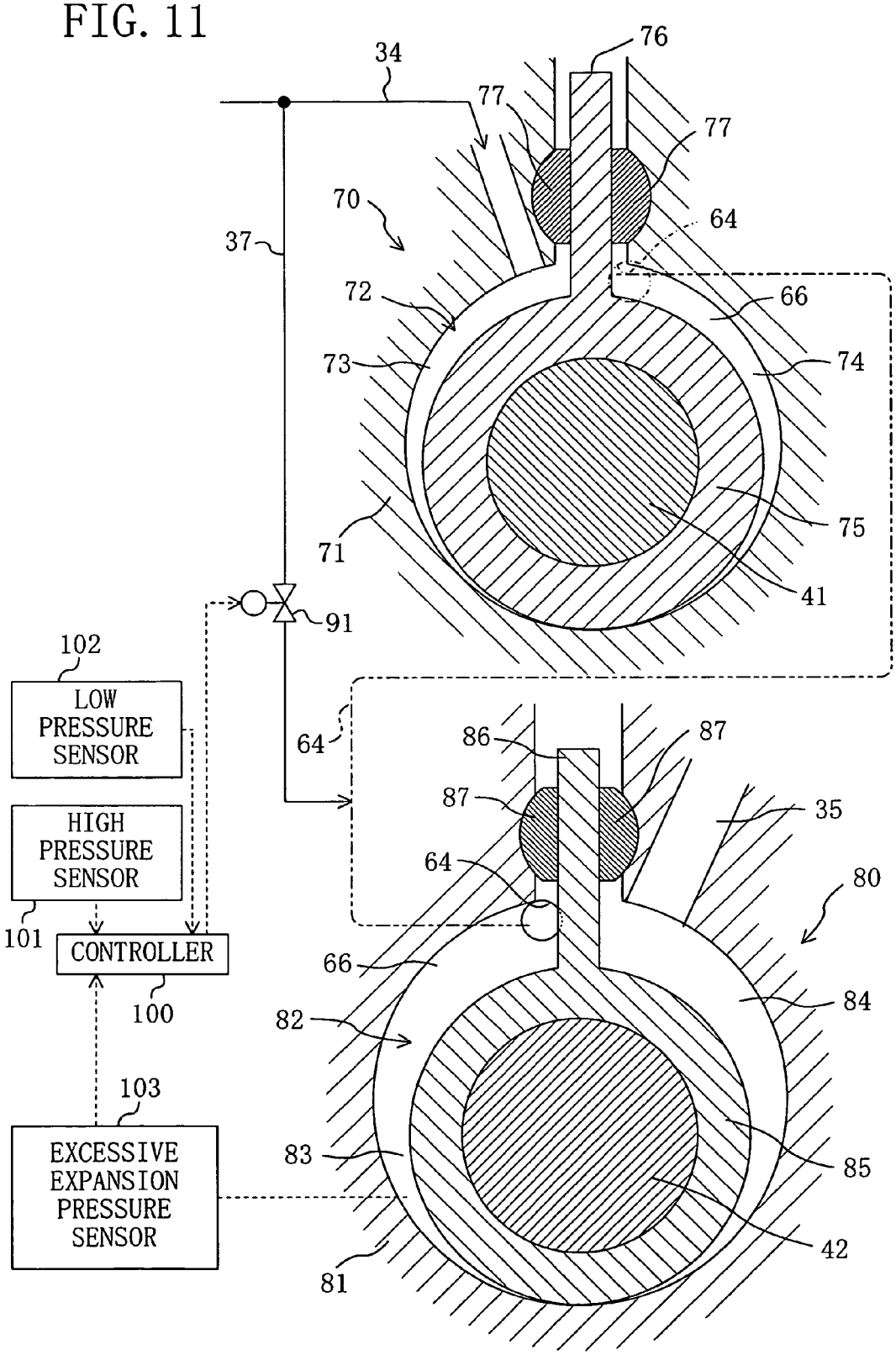
FIG. 11 is a diagram which individually illustrates in cross section rotary mechanism parts of an expansion mechanism part of a second embodiment of the present invention.

As shown in FIG. 11, the injection passageway (37) of the expansion mechanism part (60) of the present embodiment is provided with an solenoid valve (91) as a substitute for the motor-operated valve (90) of the first embodiment. In other words, the solenoid valve (91) constitutes a distribution control mechanism. The opening/closing of the solenoid valve (91) causes continuation/discontinuation of the distribution of high-pressure refrigerant in the injection passageway (37). In addition, the controller (100) of the present embodiment is configured such that it places the solenoid valve (91) in the open or closed state based on the values detected by the high pressure sensor (101), the low pressure sensor (102), and the excessive-expansion pressure sensor (103).

In the present embodiment, in the operation condition in which the expansion ratio of the refrigeration cycle agrees with the design expansion ratio of the expansion mechanism part (60), the solenoid valve (91) is placed in the closed state. On the other hand, for example, in the operation condition causing the actual expansion ratio to fall below the design expansion ratio because the low-level pressure of the refrigeration cycle drops to a lower value, the solenoid valve (91) is placed in the open state to thereby introduce high-pressure refrigerant into the expansion chamber (66) from the injection passageway (37). This therefore makes it possible to make the mass flow rate of refrigerant delivered from the expansion mechanism part (60) equal to the mass flow rate of refrigerant discharged from the compression mechanism part (50), even in the operation condition causing the actual expansion ratio to fall below the design expansion ratio. In addition, the internal pressure of the expansion chamber (66) rises when high-pressure refrigerant is introduced from the injection passageway (37), whereby the occurrence of excessive expansion is also avoided.

Third Embodiment of the Invention

A third embodiment of the present invention is described. In regard to the present embodiment, the difference from the first embodiment is described.

Figure 12:
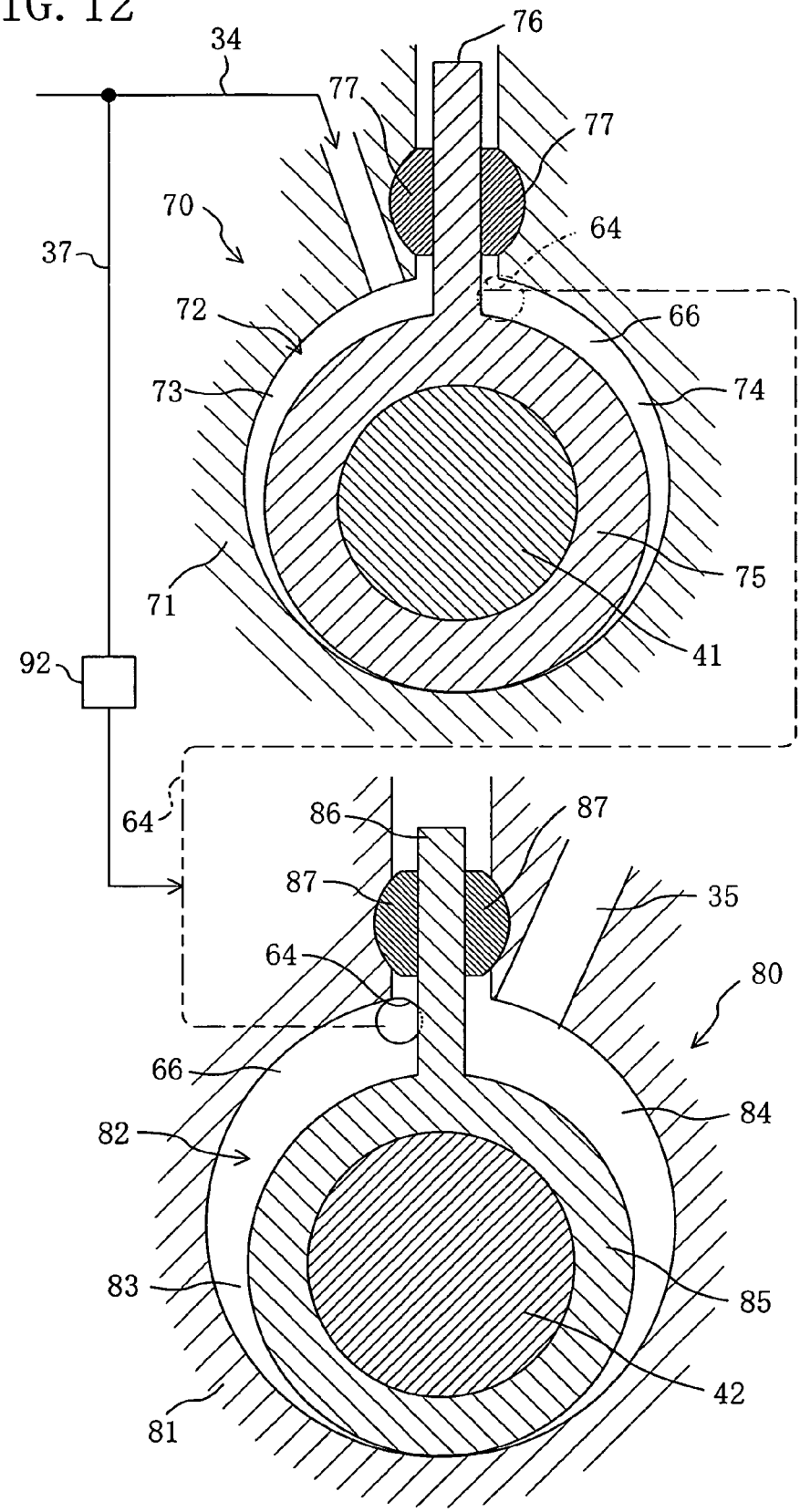
FIG. 12 is a diagram which individually illustrates in cross section rotary mechanism parts of an expansion mechanism part of a third embodiment of the present invention.

As shown in FIG. 12, the injection passageway (37) of the expansion mechanism part (60) of the present embodiment is provided with a differential pressure regulating valve (92) as a substitute for the motor-operated valve (90) of the first embodiment. That is to say, in the present embodiment, the differential pressure regulating valve (92) constitutes a distribution control mechanism. The valve opening of the differential pressure regulating valve (92) varies depending on the difference in pressure between the refrigerant in the expansion chamber (66) and the refrigerant delivered to the outflow port (35) of the second rotary mechanism part (80).

Figure 13:
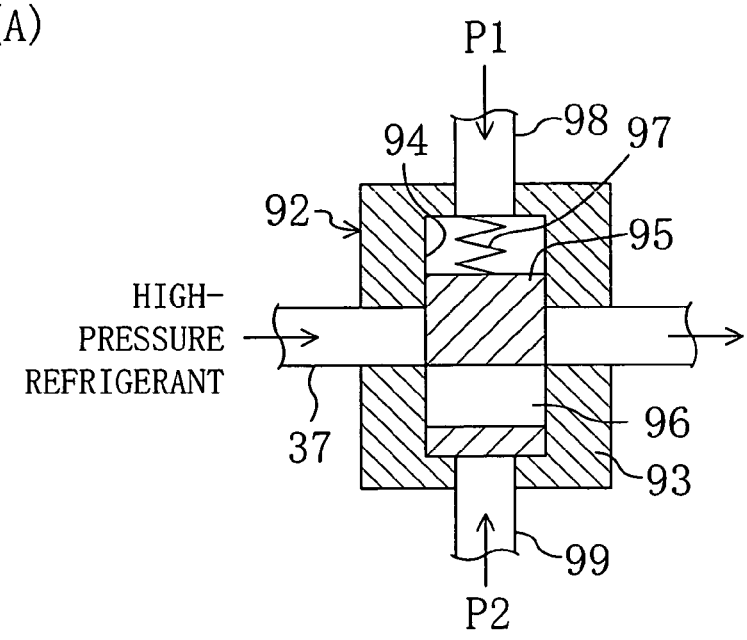
Figure 13:
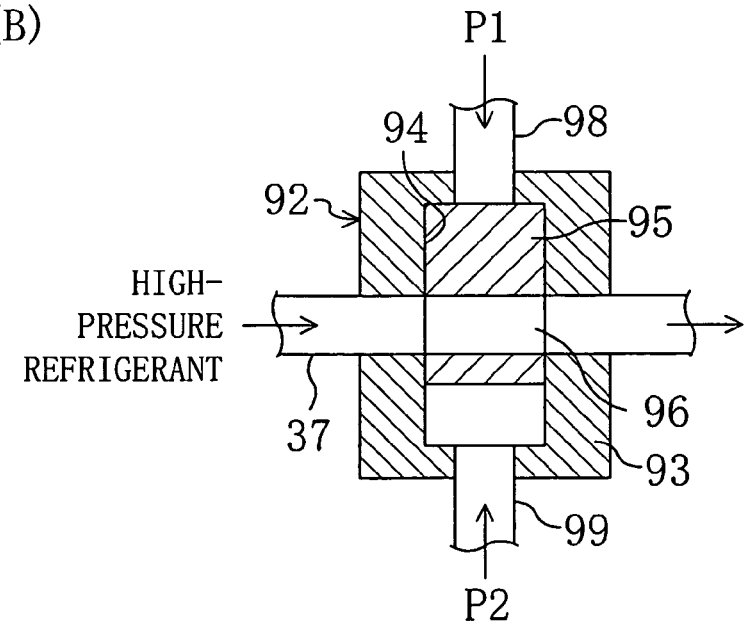

As shown in FIG. 13, the differential pressure regulating valve (92) is made up of a valve case (93) in fluid communication with the injection passageway (37), a valve body (95) which is movably mounted in the valve case (93), and a coil spring (97) which biases the valve body (95) in one direction. The valve body (95) is displaceable between a closed position which places the injection passageway (37) in the closed state and an open position which places the injection passageway (37) in the open state. The valve body (95) is biased downwardly in FIG. 13 by the coil spring (97).

The injection passageway (37) is fluidly connected to the valve case (93) in an intersectional orientation with the moving direction of the valve body (95) in the valve case (93). The valve body (95) fits into a housing recess part (94) of the valve case (93). The valve body (95) slides within the valve case (93) and moves between the closed position and the open position. In addition, the valve body (95) is provided with a communicating hole (96) for placing the injection passageway (37) in the open state at the open position and for placing the injection passageway (37) in the closed state at the closed position.

A first communicating pipe (98) in fluid communication with the expansion chamber (66) in the process of expansion, and a second communicating pipe (99) in fluid communication with the outflow port (35) are fluidly connected to the valve case (93). The first communicating pipe (98) is fluidly connected to the valve case (93) at the end on the side of the coil spring (97), i.e. at the end on the open position side of the valve body (95), and introduces a refrigerant pressure P1 in the expansion chamber (66) into the valve case (93). The refrigerant pressure P1 acts on the upper end surface of the valve body (95) in FIG. 13. On the other hand, the second communicating pipe (99) is fluidly connected to the valve case (93) at the opposite end to the coil spring (97), i.e. at the end on the closed position side of the valve body (95), and introduces a refrigerant pressure P2 at the outflow port (35) into the valve case (93). The refrigerant pressure P2 acts on the lower end surface of the valve body (95) in FIG. 13.

In the differential pressure regulating valve (92), the resultant force of the pressing force by the refrigerant pressure P1 and the bias force of the coil spring (97) and the pressing force by the refrigerant pressure P2 act on the valve body (95). When the resultant force of the pressing force by the refrigerant pressure P1 and the bias force of the coil spring (97) is greater than the pressing force by the refrigerant pressure P2, the valve body (95) moves towards the closed position. On the other hand, when the resultant force of the pressing force by the refrigerant pressure P1 and the bias force of the coil spring (97) is smaller than the pressing force by the refrigerant pressure P2, the valve body (95) moves towards the open position.

In the present embodiment, in the operation condition in which the expansion ratio of the refrigeration cycle agrees with the design expansion ratio of the expansion mechanism part (60), the resultant force of the pressing force by the refrigerant pressure P1 of the expansion chamber (66) and the bias force of the coil spring (97) becomes greater than the pressing force by the refrigerant pressure P2. Consequently, the valve body of the differential pressure regulating valve (92) moves to the closed position, and no high-pressure refrigerant is introduced into the expansion chamber (66) from the injection passageway (37). This therefore provides an ideal operation state (see FIG. 8) in which the variation in pressure of the refrigerant associated with the variation in volume of the expansion chamber (66) corresponds to the actual refrigerant pressure in the refrigeration cycle, and in the expansion mechanism part (60) power is efficiently recovered from high-pressure refrigerant.

On the other hand, if the low-level pressure of the refrigeration cycle increases above the design value due to the change in operation condition, this may cause excessive expansion in the expansion chamber (66). In such an operation condition, the pressing force by the refrigerant pressure P2 of the outflow port (35) becomes greater than the resultant force of the pressing force by the refrigerant pressure P1 and the bias force of the coil spring (97), and the valve body of the differential pressure regulating valve (92) moves towards the open position. And the differential pressure regulating valve (92) enters the open state. Then, high-pressure refrigerant is supplementarily introduced into the expansion chamber (66) from the injection passageway (37), and the pressure in the expansion chamber (66) increases, thereby preventing the occurrence of excessive expansion.

In addition, when the differential pressure regulating valve (92) is placed in the open state, this is an excessive expansion state, and the amount of refrigerant passing through the expansion mechanism part (60) becomes smaller than the amount of refrigerant passing through the compression mechanism part (50) unless high-pressure refrigerant is introduced into the expansion chamber (66) from the injection passageway (37). In such a situation, if high-pressure refrigerant is introduced into the expansion chamber (66) from the injection passageway, this makes it possible to establish equilibrium between the amount of refrigerant passing through the expansion mechanism part (60) and the amount of refrigerant passing through the compression mechanism part (50). And it becomes also possible to recover power from high-pressure refrigerant which conventionally has to bypass the expansion mechanism part (60), thereby making it possible to increase the amount of power recoverable by the expansion mechanism part (60).

Figure 14:
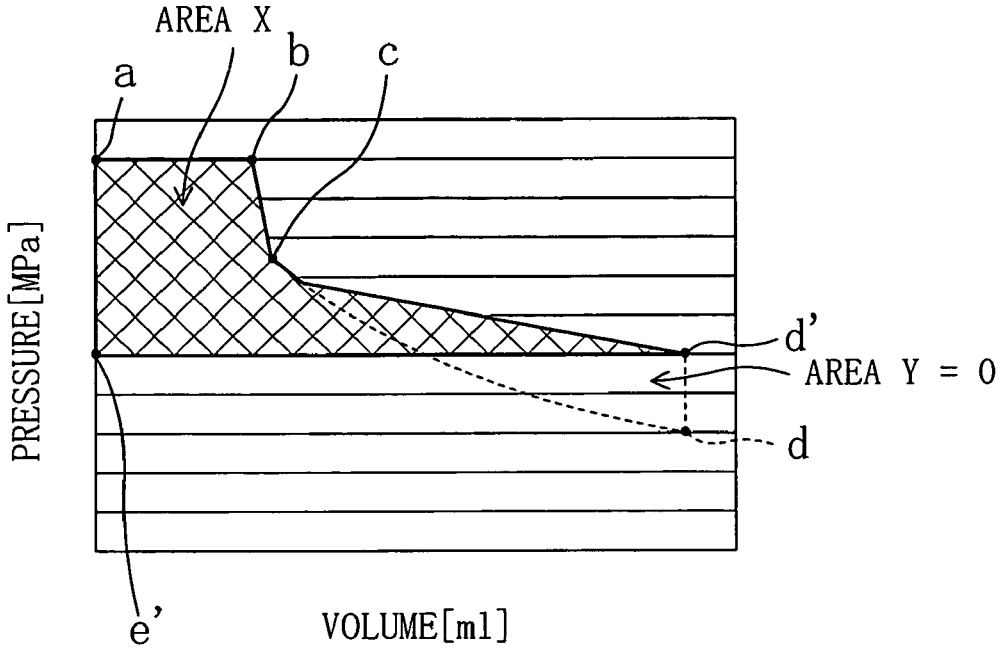
FIG. 14 is a second graph which represents a relationship between the expansion chamber volume and the expansion chamber pressure in the expansion mechanism part of the third embodiment when taking a low expansion ratio measure.

With reference to FIG. 14, there is shown an operation state of the expansion mechanism part (60) when the differential pressure regulating valve (92) is employed as a distribution control mechanism for the injection passageway (37). In this case, refrigerant flows into the first high-pressure chamber (73) between from point a to point b. Thereafter, the first high-pressure chamber (73) comes into fluid communication with the communicating passageway (64), and switches to the first low-pressure chamber (74). In the expansion chamber (66) made up of the first low-pressure chamber (74) and the second high-pressure chamber (83), the inside high-pressure refrigerant abruptly drops in pressure between from point b to point c and enters the saturated state. Thereafter, the refrigerant expands while partially being evaporated, and gradually drops in pressure to point d'. During that, at the point of time when the pressure of the refrigerant somewhat drops, the differential pressure regulating valve (92) starts opening and introduction of high-pressure refrigerant into the expansion chamber (66) from the injection passageway (37) starts. Subsequently, the second high-pressure chamber (83) comes into fluid communication with the outflow port (35) and then switches to the second low-pressure chamber (84). The refrigerant in the second low-pressure chamber (84) is delivered to the outflow port (35) until the time to point e.

In this operation state, the amount of expansion work indicated by (area X) surrounded by point a, point b, point d', and point e' is recovered as power for rotating the shaft (40). Accordingly, like the first and second embodiments, also in this case it becomes possible to increase the amount of power recoverable from high-pressure refrigerant by the expansion mechanism part (60), and the amount of electric power that the electric motor (45) consumes to drive the compression mechanism part (50) can be reduced.

It is conceivable that satisfactory effects cannot be obtained when the expansion mechanism part (60) rotates at high speed to cause a delay in the opening/closing timing of the differential pressure regulating valve (92). To cope with this, it may be arranged such that spring force is set such that the differential pressure regulating valve (92) enters the open state when the refrigerant pressure of the expansion chamber (66) approaches the refrigerant pressure at the outflow port (35).

Effects of the Third Embodiment

In the present embodiment, the valve opening of the differential pressure regulating valve (92) which forms a flow rate control mechanism varies depending on the difference in pressure between the refrigerant in the expansion chamber (66) and the refrigerant which has flowed out to the outflow port (35) from the second rotary mechanism part (80). Here, if excessive expansion occurs in the expansion chamber (66), the refrigerant pressure in the expansion chamber (66) becomes lower than the refrigerant pressure at the outflow port (35). As the refrigerant pressure in the expansion chamber (66) becomes lower relative to the refrigerant pressure at the outflow port (35), the valve opening of the differential pressure regulating valve (92) increases, thereby automatically regulating the amount of high-pressure refrigerant supply to the expansion chamber (66) from the injection passageway (37). Therefore, in accordance with the present embodiment, it is possible to optimize the amount of high-pressure refrigerant supply to the expansion chamber (66) from the injection passageway (37) without externally controlling the valve opening of the differential pressure regulating valve (92).

Other Embodiments

Figure 15:
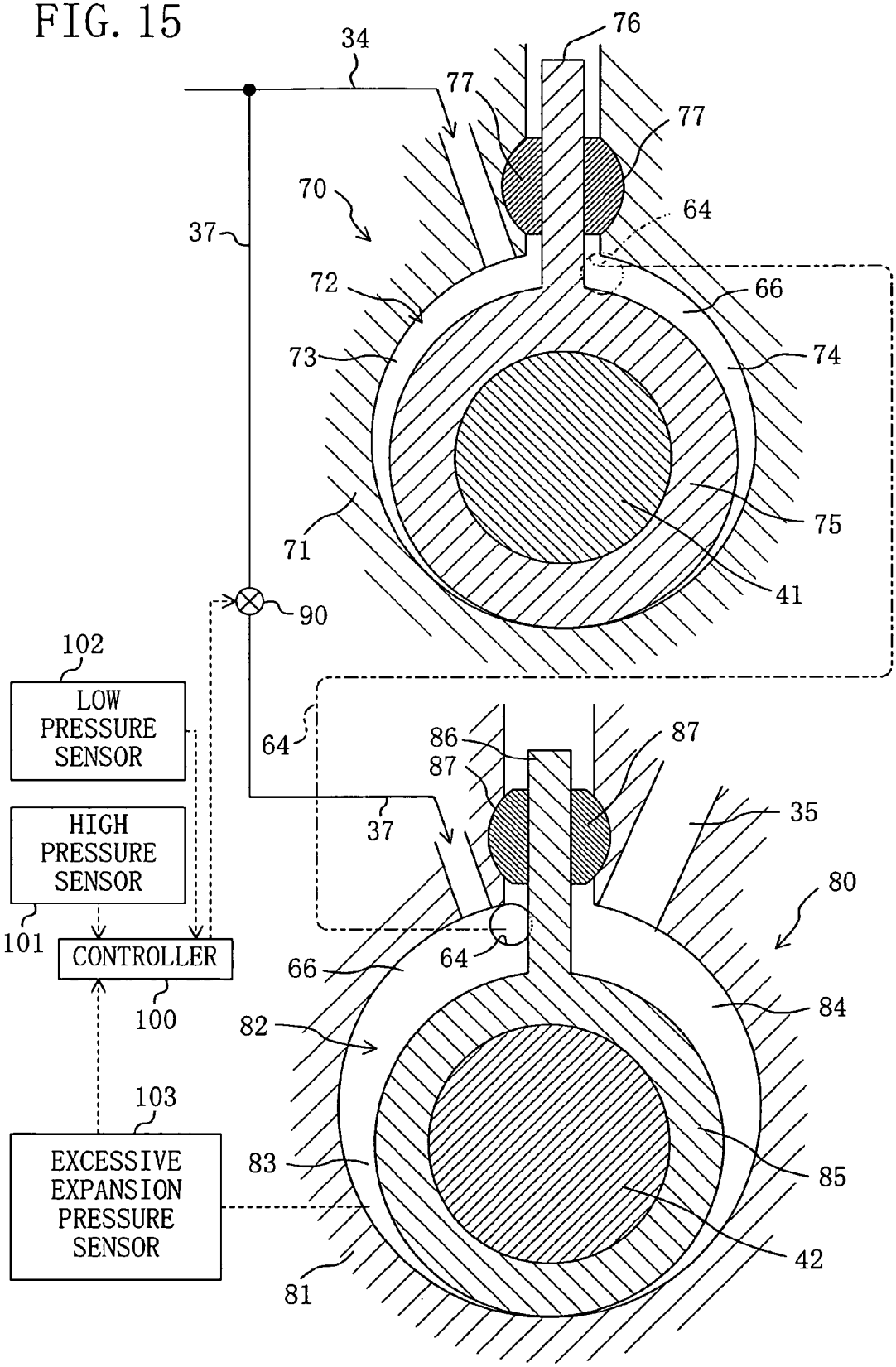
FIG. 15 is a diagram which individually illustrates in cross section rotary mechanism parts of an expansion mechanism part of another embodiment of the present invention.

Each of the foregoing embodiments may be modified such that the terminal end of the injection passageway (37) opens to the second high-pressure chamber (82) of the second rotary mechanism part (80), as shown in FIG. 15. More specifically, the terminal end of the injection passageway (37) of this modification example opens at a location of the inner peripheral surface of the second cylinder (81) in the vicinity of the left-hand side of the blade (86) of FIG. 15. And high-pressure refrigerant flowing through the injection passageway (37) is delivered to the second high-pressure chamber (82) which constitutes the expansion chamber (66).

In addition, each of the foregoing embodiments may be modified such that the expansion mechanism part (60) is formed by a rolling piston-type rotary expander. In the expansion mechanism part (60) of this modification example, the blade (76, 86) is formed as a separate body from the piston (75, 85) in the rotary mechanism part (70, 80). And the tip of the blade (76, 86) is pressed against the outer peripheral surface of the piston (75, 85) and the blade (76, 86) moves backward or forward as the piston (75, 85) moves.

It should be noted that the above-described embodiments are essentially preferable examples which are not intended to limit the present invention, its application, or its application range.

INDUSTRIAL APPLICABILITY

As has been described above, the present invention is useful for an expander which generates power by the expansion of high-pressure fluid.

What is claimed is:

1. A rotary expander which produces power by the expansion of supplied high-pressure fluid, the rotary expander comprising:

a plurality of rotary mechanism parts, each of which includes: a cylinder whose both ends are blocked; a piston for forming a fluid chamber in the cylinder; and a blade for dividing the fluid chamber into a high-pressure chamber on the high-pressure side and a low-pressure chamber on the low-pressure side; and a rotating shaft which engages with the piston of each of the plural rotary mechanism parts;

wherein:

the plural rotary mechanism parts have different displacement volumes from each other, and are connected in series in ascending order of the different displacement volumes;

in regard to two mutually connected rotary mechanism parts among the plural rotary mechanism parts one of which is a front-stage side rotary mechanism part and the other of which is a rear-stage side rotary mechanism part, the low-pressure chamber of the front-stage side rotary mechanism and the high-pressure chamber of the rear-stage side rotary mechanism part come into fluid communication with each other, resulting in the formation of a single expansion chamber, and fluid expands while flowing from the low-pressure chamber of the front-stage side rotary mechanism part into the high-pressure chamber of the rear-stage side rotary mechanism part; and the rotary expander includes: an injection passageway through which a part of the high-pressure fluid is introduced into the expansion chamber in the process of expansion; and a distribution control mechanism provided in the injection passageway.

2. The rotary expander of claim 1, wherein:

the cylinders (71, 81) of the plural rotary mechanism parts (70, 80) are stacked one upon the other in a layered manner with an intermediate plate (63) interposed therebetween;

each said intermediate plate is provided with a communicating passageway wherein, in regard to two adjacent rotary mechanism parts among the plural rotary mechanism parts one of which is a front-stage side rotary mechanism part and the other of which is a rear-stage side rotary mechanism part, the low-pressure chamber of the front-stage side rotary mechanism and the high-pressure chamber of the rear-stage side rotary mechanism part are brought into fluid communication with each other by the communicating passageway (64); and the injection passageway (37) is formed in the intermediate plate (63) so as to open, at a terminal end thereof, to the communicating passageway (64).

3. The rotary expander of claim 1, wherein the injection passageway opens, at a terminal end thereof, to the high-pressure chamber of at least one rotary mechanism part among the plural rotary mechanism parts that has a displacement volume greater than the smallest displacement volume.

4. The rotary expander of any one of claims 1-3, wherein the distribution control mechanism is formed by a regulating valve the valve opening of which is regulatable.

5. The rotary expander of any one of claims 1-3, wherein the distribution control mechanism is formed by an openable/closable solenoid valve.

6. The rotary expander of any one of claims 1-3, wherein the distribution control mechanism is formed by a differential pressure regulating valve the valve opening of which varies depending on the difference in pressure between fluid in the expansion chamber and fluid which has flowed out of a rotary mechanism part having the greatest displacement volume.

7. The rotary expander of any one of claims 1-3, wherein fluid which is introduced into the high-pressure chamber of a rotary mechanism part having the smallest displacement volume is carbon dioxide above critical pressure.

* * * * *